US006666652B2

(12) United States Patent
Bucher et al.

(10) Patent No.: US 6,666,652 B2
(45) Date of Patent: Dec. 23, 2003

(54) SLIDE IN, HOOK AND FOLD OUT CEILING FAN BLADES

(75) Inventors: Charles E. Bucher, Valrico, FL (US); John C. Bucher, Ft. Lauderdale, FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 36 days.

(21) Appl. No.: 09/874,489

(22) Filed: Jun. 5, 2001

(65) Prior Publication Data

US 2002/0182076 A1 Dec. 5, 2002

Related U.S. Application Data

(60) Continuation-in-part of application No. 09/858,220, filed on May 15, 2001, which is a continuation-in-part of application No. 09/405,676, filed on Sep. 24, 1999, now Pat. No. 6,352,411, which is a continuation-in-part of application No. 09/200,607, filed on Nov. 30, 1998, now Pat. No. 6,171,059, which is a division of application No. 08/851,501, filed on May 5, 1997, now Pat. No. 6,010,306.

(51) Int. Cl.[7] ..... F04D 29/36
(52) U.S. Cl. ..... 416/210 R; 416/244 R
(58) Field of Search ..... 416/5, 210 R, 416/244 R, 500; 415/119

(56) References Cited

U.S. PATENT DOCUMENTS

| | | | | | |
|---|---|---|---|---|---|
| 2,771,259 | A | | 11/1956 | Laystrom | 248/28 |
| 2,965,180 | A | | 12/1960 | Killam | 416/210 |
| 4,050,771 | A | | 9/1977 | Watson | 339/263 |
| 4,121,495 | A | | 10/1978 | Malo | 85/1 |
| 4,511,310 | A | | 4/1985 | Pearce | 416/134 |
| 5,397,206 | A | | 3/1995 | Sihon | 411/544 |
| 5,433,585 | A | * | 7/1995 | Yan | 416/5 |
| 5,462,412 | A | | 10/1995 | Scofield | 416/210 |
| 5,873,701 | A | | 2/1999 | Shiu | 416/205 |
| 5,927,945 | A | | 7/1999 | Chen | 416/5 |
| 5,944,486 | A | | 8/1999 | Hodgkins, Jr. | 416/210 |
| 5,944,487 | A | | 8/1999 | Pearce | 416/244 |
| 5,951,197 | A | | 9/1999 | Wu | 403/315 |
| 5,954,449 | A | | 9/1999 | Wu | 403/315 |
| 5,980,353 | A | | 11/1999 | Wu | 446/210 |
| 6,010,306 | A | | 1/2000 | Bucher et al. | 416/210 |
| 6,027,309 | A | | 2/2000 | Rawls | 416/5 |
| 6,027,310 | A | | 2/2000 | Kerr | 416/210 |
| 6,039,540 | A | * | 3/2000 | Wu | 416/210 R |
| 6,095,753 | A | | 8/2000 | Hsu | 416/207 |
| 6,213,716 | B1 | | 4/2001 | Bucher | 416/142 |
| 6,261,064 | B1 | * | 7/2001 | Tang | 416/210 R |
| 6,309,183 | B1 | * | 10/2001 | Bucher et al. | 416/500 |
| 6,347,924 | B1 | * | 2/2002 | Chang | 416/210 R |
| 6,352,409 | B1 | * | 3/2002 | Blateri et al. | 416/210 R |

FOREIGN PATENT DOCUMENTS

| | | | |
|---|---|---|---|
| GB | 2 276 219 | 9/1994 | 267/141 |

* cited by examiner

*Primary Examiner*—Edward K. Look
*Assistant Examiner*—Igor Kershteyn
(74) *Attorney, Agent, or Firm*—Brian S. Steinberger; Law Offices of Brian S. Steinberger, P.A.

(57) ABSTRACT

Slide in, hook on and lock blades for ceiling fans having vibration and noise reduction through resilient members. A mount attached to the motor can be bendable by a hinge so a raised portion can receive a slot on the blade. The mount has a post where a blade can be hooked. Folding the blade locks the blade substantially eliminating lateral and vertical movement of the blade and can also eliminate vibration and noise. A clip can be used to lock the blade or eliminate lateral and/or vertical movements. An expandable and contracting clip can hold the blade and can be used with a post or posts, and can quickly allow the blade to be snapped into place. The invention allows centrifugal forces and/or the overall weight of the blades(by gravity) to hold the blades.

38 Claims, 16 Drawing Sheets

210
212A
212B
242
244
224
S
222
220
223
240
200

210
212B
212A
Q
236
223
240

210
212B
212A
234
223
232
240

210
212A
212B
233
223
240

210
B
B
240
212A 210
212B
213B
213A
212A
232
222
223
240
L

SLIDE IN, HOOK AND FOLD OUT CEILING FAN BLADES

This invention is a Continuation-In-Part of Ser. No. 09/858,220 filed May 15, 2001, which is a Continuation-In-Part of Ser. No. 09/405,676 filed Sep. 24, 1999, now U.S. Pat. No. 6,352,411 which is a Continuation-In-Part of application Ser. No. 09/200,607 filed on Nov. 30, 1998, now U.S. Pat. No. 6,171,059 which is a Divisional of Ser. No. 08/851,501 filed May 5, 1997, now U.S. Pat. No. 6,010,306, all by the same inventors and assignee as the subject application which are all incorporated by reference, and this invention relates to ceiling fans, and in particular to ceiling fans having reversible blades that either hook and fold out to locked positions or reversible blades that slide over angled arm ends, hook over at least one alignment post and fold out to locked positions during assembly or blades that slide into slots of a motor housing, and this invention is related to pending application Ser. No. 09/989,827 filed Nov. 21, 2001 which is a Divisional of Ser. No. 09/708,291 filed Nov. 8, 2000, now U.S. Pat. 6,336,792 which is a Divisional of Ser. No. 09/200,607 filed Nov. 30, 1998, now U.S. Pat. No. 6,171,059 which is a Divisional of Ser. No. 08/851,501 filed May 5, 1997, now U.S. Pat. No. 6,010,306, all by the same inventors and assignee as the subject application which are all incorporated by reference, all to the same inventors and assignees as the subject invention, and which relates to U.S. Pat. No. 6,213,716 to Bucher et al., the same inventors and assignees, which is incorporated by reference.

BACKGROUND AND PRIOR ART

Conventional ceiling fans that are shipped in cartons have separate packing materials such as foam inserts for the many components that must be assembled by the installer to hang the ceiling fan. For example, ceiling fan blades are generally shipped in detached positions and are fastened onto the motors and ceiling fan arms by screw type fasteners during the assembly process, a practice having many inherent problems.

A single conventional ceiling fan blade has often required some five screw type fasteners to attach the blade to the motor/arm of the ceiling fan. Thus, a five blade ceiling fan can have some twenty five screw type fasteners just for attaching the fan blades to the motor and arm assembly. Clearly, problems occur when any of this small screw type fasteners become lost and/or missing during the assembly process.

In addition to having multiple loose parts, a typical installer must follow a tedious process in order to assemble and hang the ceiling fan. In FIG. 1, a conventional ceiling fan motor housing 10 has a rotor component 20 that rotates about a central axis within a motor housing 10, which in turn is connected to a hanger assembly 5 that is attached beneath a ceiling 2. A plurality of fan blades 30 can be connected to the rotor 20 by mounting arms 40. Each mounting arm 40 has one end 42 connected to an end 32 of each fan blade 30, and an opposite second end 44 having at least two through-holes 45 therethrough, so that conventional screw type fasteners 50 can pass through the through-holes 45 to mateably thread into threaded holes 25 in the bottom of rotor 20.

It is usual in many ceiling fan installation directions to have the installer first connect and hang the motor housing 10, rotor 20 and hanger assembly 5 to a ceiling by having the installer standing on a raised platform such as a ladder or stool. Next, the installation directions have the installer attach the blades 30 to their respective mounting arms/motor connectors 40. Finally, a last step is to connect the blade 30 and respective mounting arm 40 to the rotor 20 on the motor housing 10.

This final assembly step takes great dexterity, patience, balance and time for the installer. In order for a single person 60 to be able to complete this final step, the installer 60 needs to hold in one hand 62 the fan blade 30 and already attached mounting arm 40, and to position a screw driver 70 to the heads of the screws 50 with the other hand 64. The installer must be able to balance the mounting screws 50 on the tip of the screw driver 70, insert the screws upwardly through the holes 44 in the mounting arm, making sure not to accidentally drop the screws 50 and then screw the screws 50 into the mating holes 25 on the rotor 20 all while still holding the blade 30 and arm 40. This assembly requires the installer to have to constantly hold both hands 62 and 64 raised high above their head, while again standing on the ladder or stool.

This tedious traditional process of assembly and installation causes many potential problems. First, the screw type fasteners can and do accidentally fall and become lost causing more time and expense to finish the installation. The installer 60 often has to constantly reposition the blade 30 and arm 40 in order to be able to properly line up the through-holes 45 in the mounting arms 40 with their respective mating holes 25 in the bottom of rotor 20. Also, the blade 30 and mounting arm 40 have been known to fall on and cause injury to the installer 60 during assembly. Furthermore, the installer can lose their balance and injure themselves by falling off the ladder or stool.

The use of screws has other inherent problems as to their appearance. The screw type fasteners are often visible from those looking up at the running ceiling fans. Visible screws are unsightly and further detract from the appearance of the ceiling fan itself.

Still additional problems have been known to occur after installation of the screw type fasteners. For example, uneven tightening of each of the plural screw type fasteners that connect the blades to the mounting arms has resulted in wobble effects when the ceiling fan is running. The wobble effects can include both lateral and/or vertical movement between the blades and the blade arms, or between the blades and the motors, or between the blade arms and the motors.

Another problem occurs as a result of the need to clean blades over time in order to remove dirt and dust buildup. Current techniques have relied on manually holding brushes to the ceiling fan attached blades themselves which inherently tires the muscles in the cleaner's back, neck, shoulders, arms and hands. Furthermore, this messy cleaning operation with brushes while the blades are attached to the ceiling fan mounted motor often results in dirt and debris falling on both the cleaner and furniture and flooring below the ceiling fan.

Another problem occurs when the ceiling fan is taken down to be reboxed. In order to be repackaged, each and every component must be disassembled, a time consuming endeavor, which also can result in many loose parts becoming misplaced and lost over time.

A still another problem with blades having removable fasteners includes inherent problems with vibrations and noise that result from the spinning blades. Allowing some different parts to directly contact one another such as metal blade arms contacting metal blades allows for vibrations and noise to result.

Various solutions to changing some of the traditional attachment methods referred above have been proposed. See for example, U.S. Pat. No. 5,944,486 to Hodgkins, Jr. The Hodgkins '486 patent describes an "Interchangeable Fan Blade System", title. However, the embodiments generally require some screw type fasteners be used that still would have many of the problems described above. Furthermore, the slots shown in FIGS. 2, 3 and 9, and adapter plates shown in FIGS. 5A–5G would have problems in fixably securing the blades to the adapters so that the blades would not wobble nor rattle when being run during a ceiling fan use. For example, the hook arm in FIG. 5D would not by itself adequately secure the fan blades in position by solely relying on a "centrifugal force." Besides the wobble and rattle problems, each time the ceiling fan stops the hooked on blades can potentially fall off and become damaged as well as injure those beneath the ceiling fan. Similarly the "pin" supported blades of FIG. 5F would also wobble and rattle for not being properly secured to the mounting arms. In addition, these "pins" can inherently become loose and cause the blades to possibly fall off, become damaged and possibly injure those beneath the ceiling fan.

Furthermore, the Hodgkins '486 reference fails to take into account the inherent vibration and noise problems that can result when using fasteners such as screws, and the like. Additionally, other embodiments in this reference allow some parts to directly contact one another, such as metal arms directly contacting metal blades, and the like, which would result in undesirable vibration and noise. Thus, the need exists for solutions to the above problems.

SUMMARY OF THE INVENTION

A first objective of the subject invention is to provide ceiling fan blades that can be easily and quickly attached onto a ceiling fan mounted motor without the need of using removable fasteners such as screws and the like.

The second objective of the subject invention is to provide mountable ceiling fan blades that become instantly aligned when being mounted.

The third objective of the subject invention is to provide ceiling fan blades that do not rattle nor wobble when being run on a ceiling fan.

The fourth objective of the subject invention is to provide ceiling fan blades that can be reversibly hung without using removable fasteners such as screws and the like.

The fifth objective of the subject invention is to provide ceiling fan blades that slide into a space formed between a raised end of a blade arm and the rest of the blade, lock onto an alignment post and become locked when the blade is folded outward.

The sixth objective of the subject invention is to provide ceiling fan blades that easily lock onto a ceiling fan without the use of fasteners having enhanced vibration reduction and minimize noise transmission between the blades and the ceiling fan.

The seventh objective of the subject invention is to provide ceiling fan blades that easily lock onto a ceiling fan blade arm without the use of fasteners such as screws and the like.

The eighth objective of the subject invention is to provide ceiling fan blades having a built on medallion cover that does not need to be separated fastened thereon.

The ninth objective of the subject invention is to provide ceiling fan blades having enhanced vibration reduction and minimized noise transmission between the ceiling fan blades and the ceiling fan motor.

The tenth objective of the subject invention is to provide ceiling fan blades having enhanced vibration reduction and minimized noise transmission between the ceiling fan blades and the blade arms.

The eleventh objective of the subject invention is to provide attachments for ceiling fan blades that eliminates lateral and vertical movement between the blades and the blade arms.

The twelfth objective of the subject invention is to provide attachments for ceiling fan blades that eliminates lateral and vertical movement between the blades and the fan motors.

The thirteenth objective of the subject invention is to provide attachments for ceiling fan blades that eliminates lateral and vertical movement between the blade arms and the motors.

The fourteenth objective of the subject invention is to provide for blades that can be pre-attached to ceiling fan motors and packed in a box so that an installer only has to pull the motor and blade assembly out of a box and hang it from a ceiling.

The fifteenth objective of the subject invention is to provide for blades that can be hooked and clipped onto a ceiling fan.

The sixteenth objective of the subject invention is to provide for blades that can be held onto a ceiling fan by centrifugal force.

The seventeenth objective of the subject invention is to provide for blades that can be held onto a ceiling fan and held in place by gravity.

The subject invention is a Continuation-In-Part of Ser. No. 09/858,220 filed on May 15, 2001 to the same inventors and assignees as the subject invention, and which relates to U.S. Pat. No. 6,213,716 to Bucher et al., the same inventors and assignees, both of which are incorporated by reference.

The subject invention includes two embodiments of hook and fold blades and multiple embodiments describing blades that slide over bent arm ends, hook onto at least one alignment post and folds out to a locked position during assembly, and another embodiment of angling a blade into a slot and hooking the blade and folding the blade down into a locked position.

Both of the first embodiments include a ceiling fan motor having a rotating member, a first mount attached to the rotating member, a first fan blade having a first interior end portion and a first exterior end portion, a first hook portion which hooks the first mount to the first interior end portion, and a lock portion for restricting lateral movement between the first mount and the first interior end portion, wherein centrifugal force further locks the first fan blade to the first mount. The first mount can be on the first fan blade arm, or on a portion of a rotor on the motor. The locking portion can include edges having a cavity therebetween, wherein a portion of the first hook portion becomes positioned and locked within the cavity. One embodiment has the first hook portion attached to and extends outward away from the first interior portion of the first blade. Another embodiment has the first hook portion attached to and extends outward away from the first mount attached to the rotating member. The first hook portion can be attached to the first interior portion of the first blade and extends to the first exterior portion of the first blade. The first hook portion can be attached to the first mount toward the rotating member. The blades can be reversible in at least one of the embodiments.

For both of the first and second embodiments there is a novel method of attaching the ceiling fan blades without using any removable fasteners, that includes the steps of hooking one end of a fan blade to a mount attached to a ceiling fan motor, and locking the fan blade to the ceiling fan motor with at least one technique to eliminate any lateral movement between the fan blade and the mount. The techniques can include either or both inserting a narrow body portion to be tightly fit or mateably fit between two raised edges/walls/arms, and/or positioning a raised ridge type portion into a mateably receiving indentation.

The third embodiment allows for an end of the ceiling fan blade arm to bend on a hinge to allow a space for allowing an end of a ceiling fan blade to be inserted into the space. At least one through hole on the blade end hooks over and slides onto a raised post from the bent arm end. Next, the blade is folded down to a locked position. Vibration isolators such as but not limited to washers, grommets, cushions, pads, and the like, combinations thereof, and the like, can be inserted over the raised post(s), and/or be located adjacent between the blade end and the bent arm portions abutting against the blade end and/or in any area where components abut against one another. The third embodiment allows for enhanced operation without lateral and vertical movement between the blades and the arms/motors. The invention further allows for operation without vibration and noise that often occurs with prior art blade attachment techniques. This embodiment allows for tight fits between the blades and ceiling fan arms, or between the blades and the ceiling fan motors.

A fourth embodiment can be used with the third embodiment and allows for a spring type clip to further lock the blade to the ceiling fan motor. The clip can be pre-attached for example, to the medallion portion and when the blade and medallion are folded downward can expand about and contact against or about portions of the arm, the hinge portion on the arm, and the like. The clip can also restrict lateral and or vertical movement between the blade and the ceiling fan motor. The clip can be used with one or more posts, and with or without any vibration and noise type resilient members.

A fifth embodiment allows for blades to be slided into a slot opening in the side band of a ceiling fan motor, pivoted about the slot opening so that the blade hooks onto a motor mount by post(s) passing through a through-hole, and/or uses an expandable and contractible type clip such as but not limited to a spring type clip that snapably locks the blade in a horizontal position. The post(s) and clip can be located on a motor mount, the blade or both the blade and the mount. The invention can be practiced using post(s) without the clip. Additionally, the invention can be practiced using the clip without the post(s). Since the overall weight of the blade is to the side of the pivot point opposite where the blade attaches to the motor, then gravity will continuously pull the blade downward so that the blade end constantly abuts against the motor mount. Thus, this embodiment allows for the gravity of the blade to further lock and hold the blade to the ceiling fan. Similar to all of the preceding embodiments, centrifugal force of the resultant spinning blades allows the blades to be held in place to the ceiling fan.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

First Embodiment

This invention is further related to U.S. Pat. No. 6,010,306 to Bucher et al. and U.S. Pat. No. 6,171,059 to Bucher et al.; and U.S. Pat. No. 6,213,716 to Bucher et al., each having the same inventors and assignee as the subject invention and each being incorporated by reference.

Figure 1:
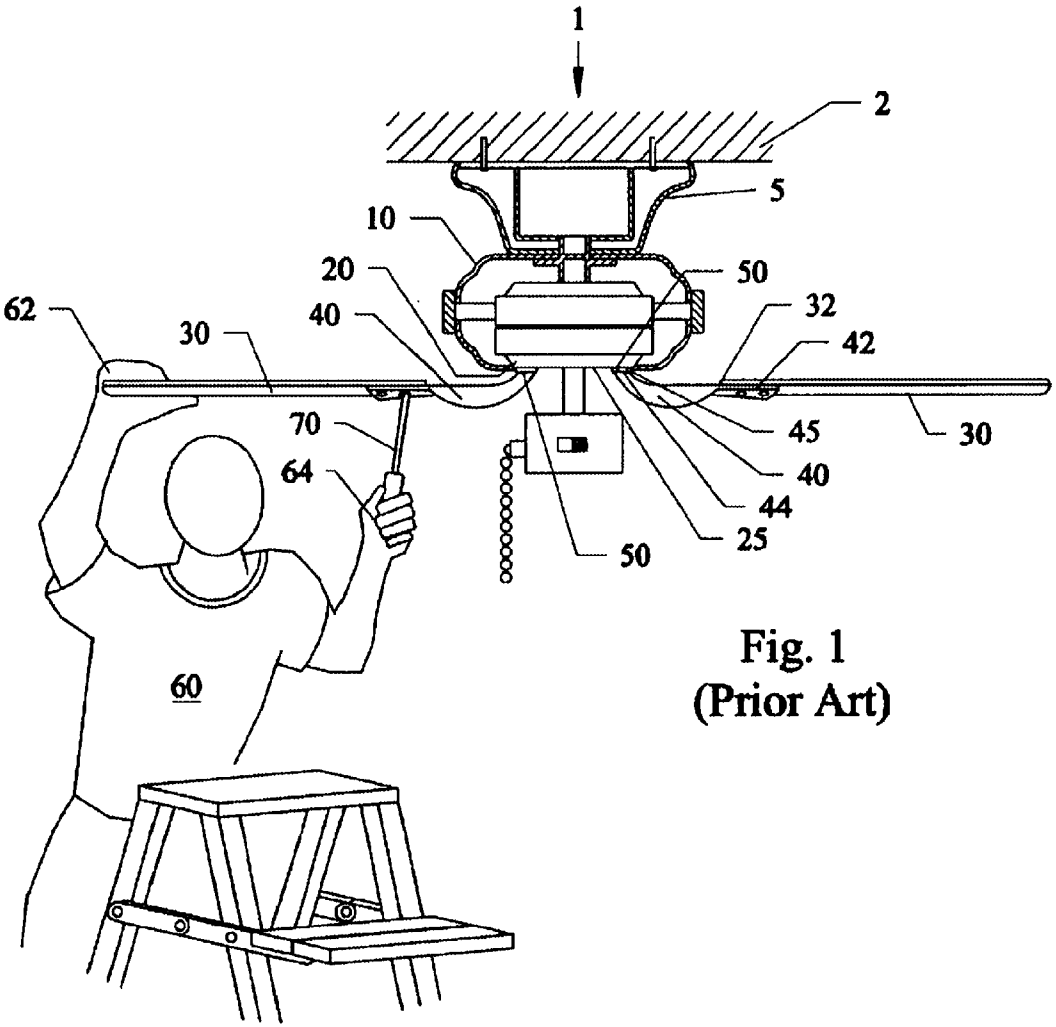
Fig. 1 (Prior Art)
FIG. 1 shows a prior art view of a blade with mounting arm attached to a ceiling fan motor and rotor.
Figure 2A:
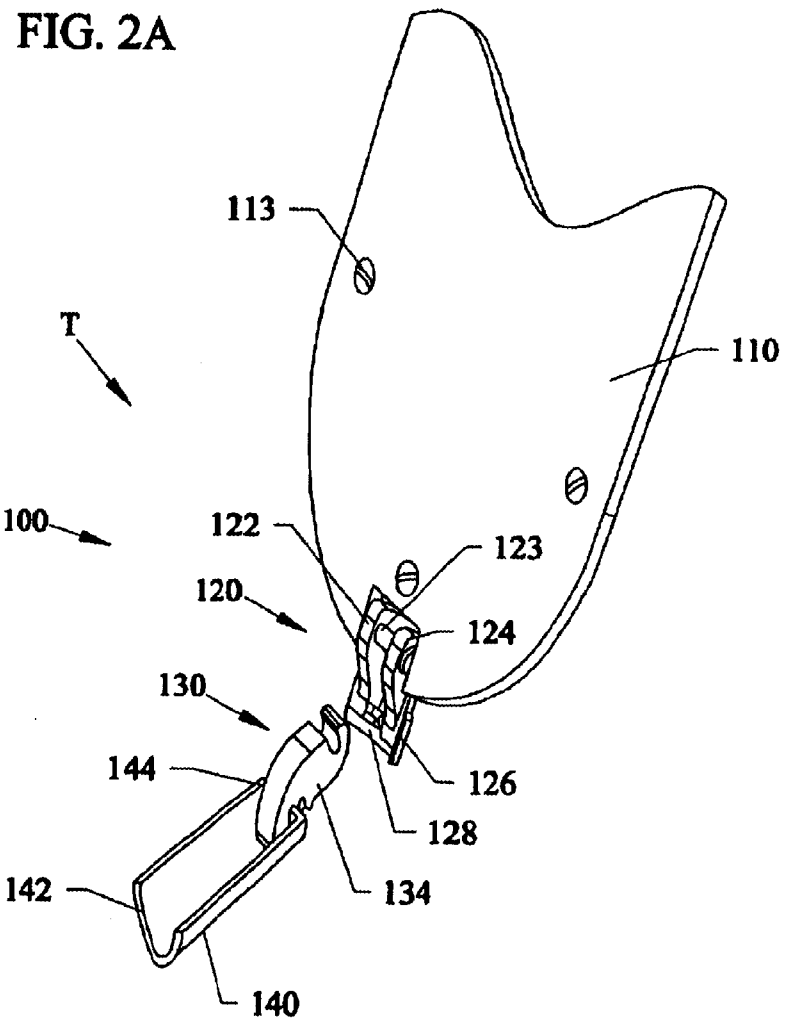
FIG. 2A is a perspective view of a first embodiment of the hook and fold ceiling fan blade with a blade ready to be attached to a motor/arm.
Figure 2B:
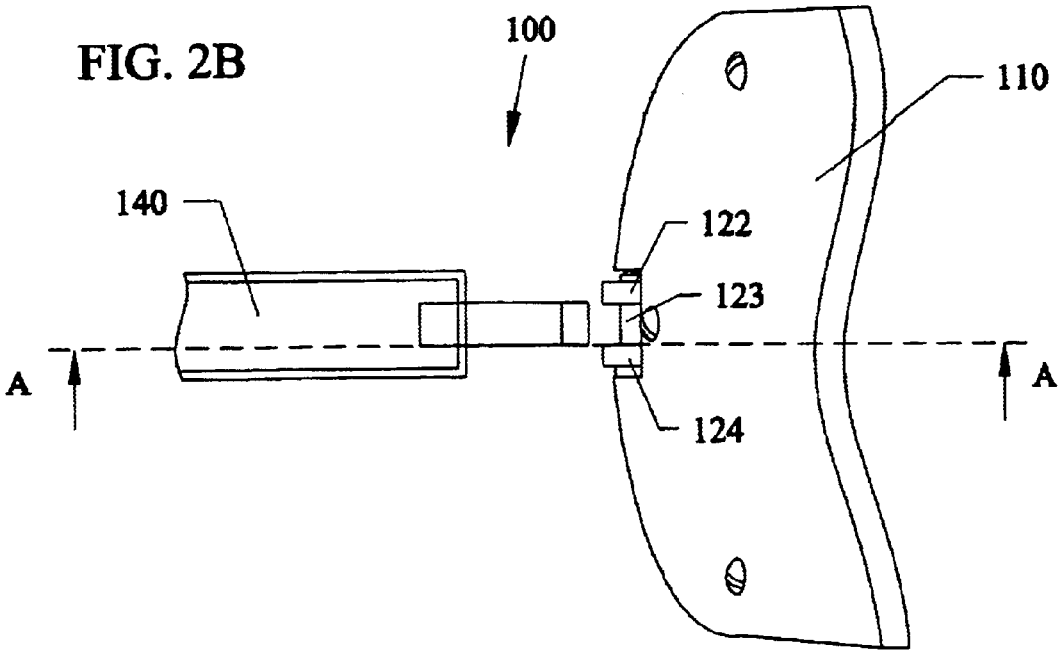
FIG. 2B is a top view of FIG. 2A along arrow T.
Figure 2C:
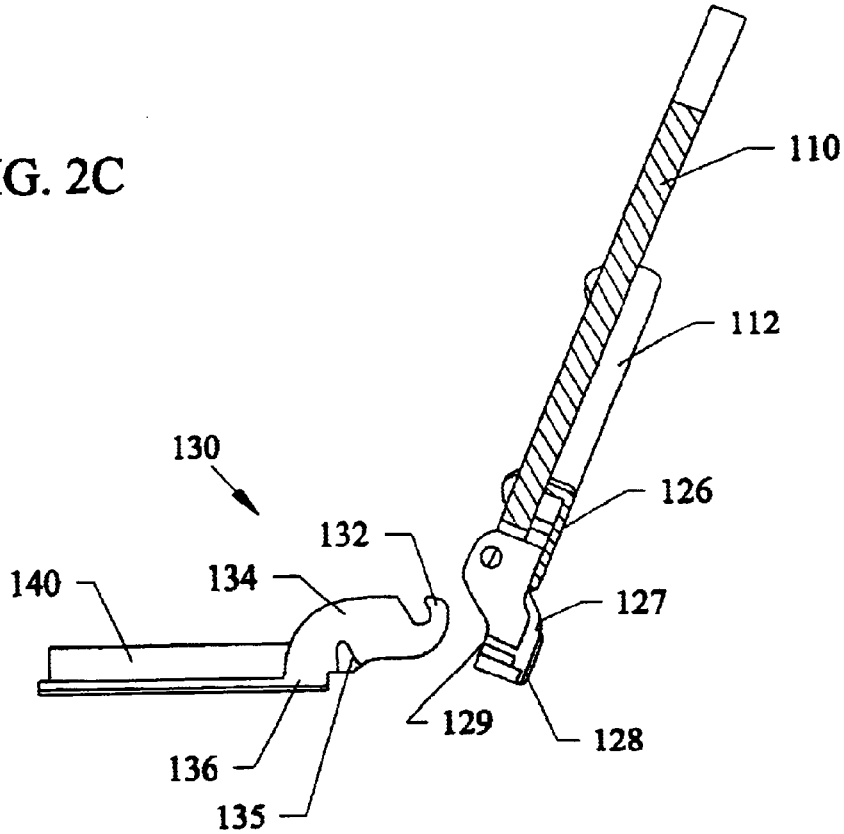
FIG. 2C is a side cross-sectional view of FIG. 2B along arrows A—A.

FIG. 2A is a perspective view of a first embodiment 100 of the hook and fold ceiling fan blade with a blade 110 ready to be attached to a motor/arm 140. FIG. 2B is a top view of FIG. 2A along arrow T. FIG. 2C is a side cross-sectional view of FIG. 2B along arrows A—A. Referring to FIGS. 2A–2C, ceiling fan blade 110 can have a medallion cover 112, attached thereon with fasteners 112, such as screws, and the like. Attached to the medallion 112 can be a connector section 120 having two raised wall type members 122, 124 with a pin member 123 connected attached therebetween. The bottom of connector 120 has an upper bottom surface 126, which steps down at 127 to a lower bottom surface 128. A raised ridge type member 129 is positioned in front of wall members 122, 124. A ceiling fan motor arm 140 has one end 142 that can be attached to a motor/rotor 50 such as that shown in FIG. 1. Arm 140 can be a solid member or be hollow or have an open upper surface such as a half cylinder. The outer dimensions of the arm can be of any desired shape, such as but not limited to cylindrical, rectangular, and the like. The opposite end 144 of arm 140 can include a hook connector 130, having a hook portion 132 and a mid narrow raised body portion 134 that attaches the hook portion 132 to the arm 140. Hook connector 130 can be formed with arm 140 or be separately attached at end 136 by conventional fasteners such as screws, and the like. On the underside of hook connector 130 can be an indentation 135.

The subject invention can be assembled by initially hanging the ceiling fan motor as shown in FIG. 1, with the blades to be attached thereafter. The method of attaching the blade 110 to the motor/arm of the ceiling fan 140 will be described in reference to FIGS. 2C and 3–4.

Figure 6:
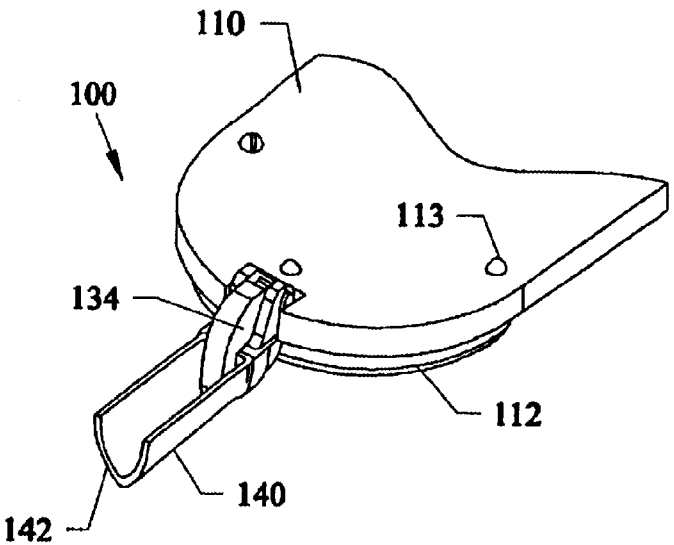
FIG. 6 is a perspective view of the preceding figures in a fully attached state.
Figure 3:
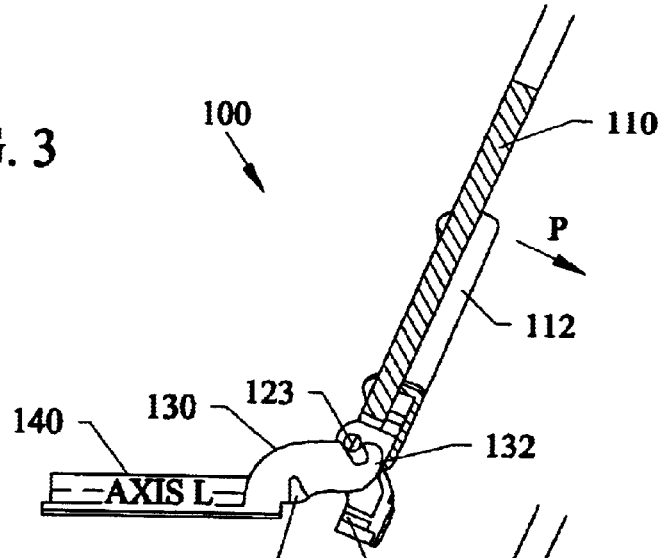
FIG. 3 is another view of FIG. 2C with the hook starting to be inserted about the pin.
Figure 4:
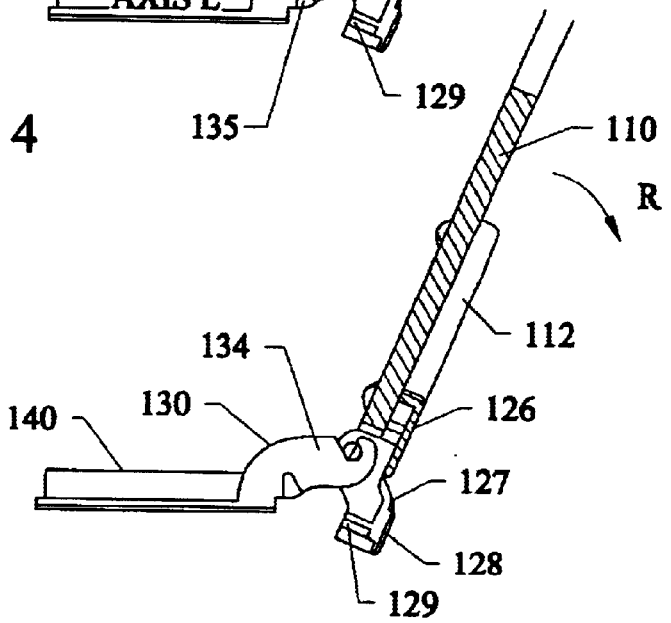
FIG. 4 is another view of FIG. 3 with the hook being fully wrapped about the pin.
Figure 5:
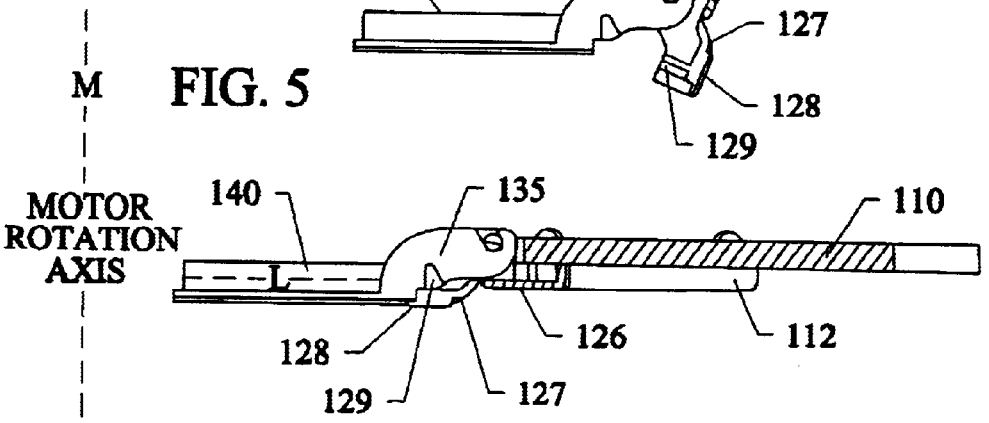
FIG. 5 is another view of FIG. 4 with the blade in a folded down position.

An installer can initially orient the blade 110 off axis to the longitudinal axis L, of the motor arm 140. FIG. 3 the hook portion 132 starting to be inserted about the pin 123. Next, the installer can pull or push the blade 110 in the direction of arrow P so that the hook portion 132 is fully attached. FIG. 4 is another view of FIG. 3 with the hook being fully wrapped about the pin. Finally, the blade 110 is folded down in the direction of arrow R. FIG. 5 is another view of FIG. 4 with the blade in a folded down position with the blade 110 in the same plane as the axis L of the arm 140. FIG. 6 is a perspective view of the final folded down position of the blade 110.

The two different techniques of locking the blade 110 to the arm 130 will now be discussed in reference to FIGS. 2A, 2B, 5 and 6. The narrow body portion 134 of hook connector 130 slides into and becomes sandwiched between the raised edges 122, 124 of connector 120. A tight sized space between edges 122, 124 allows for a tight fit when the narrow body portion 134 of hook connector 130 has been placed therein. The bottom uneven surface 134 of hook connector 130 abuts against the inner upper surface 126 and inner step surface 127 of connector 120 to complete the first locking technique. A second locking technique occurs when raised ridge member 129 of connector 120 can become mateably seated into the indentation groove 135 of hook connector 130 locking the blade 110 to the arm 140. A tight and/or snap fit between the raised ridge member 129 and indentation groove 135 can also be used. Either or both locking techniques described will restrict any lateral (side-to-side) movement of the blade 110 relative to the arm 140. Although, the two locking techniques are shown the invention can be practiced with either one. Using both locking techniques acts as an extra safety feature to lock the blade 110 to the motor/arm 140.

Second Embodiment

Figures 7A, 11:
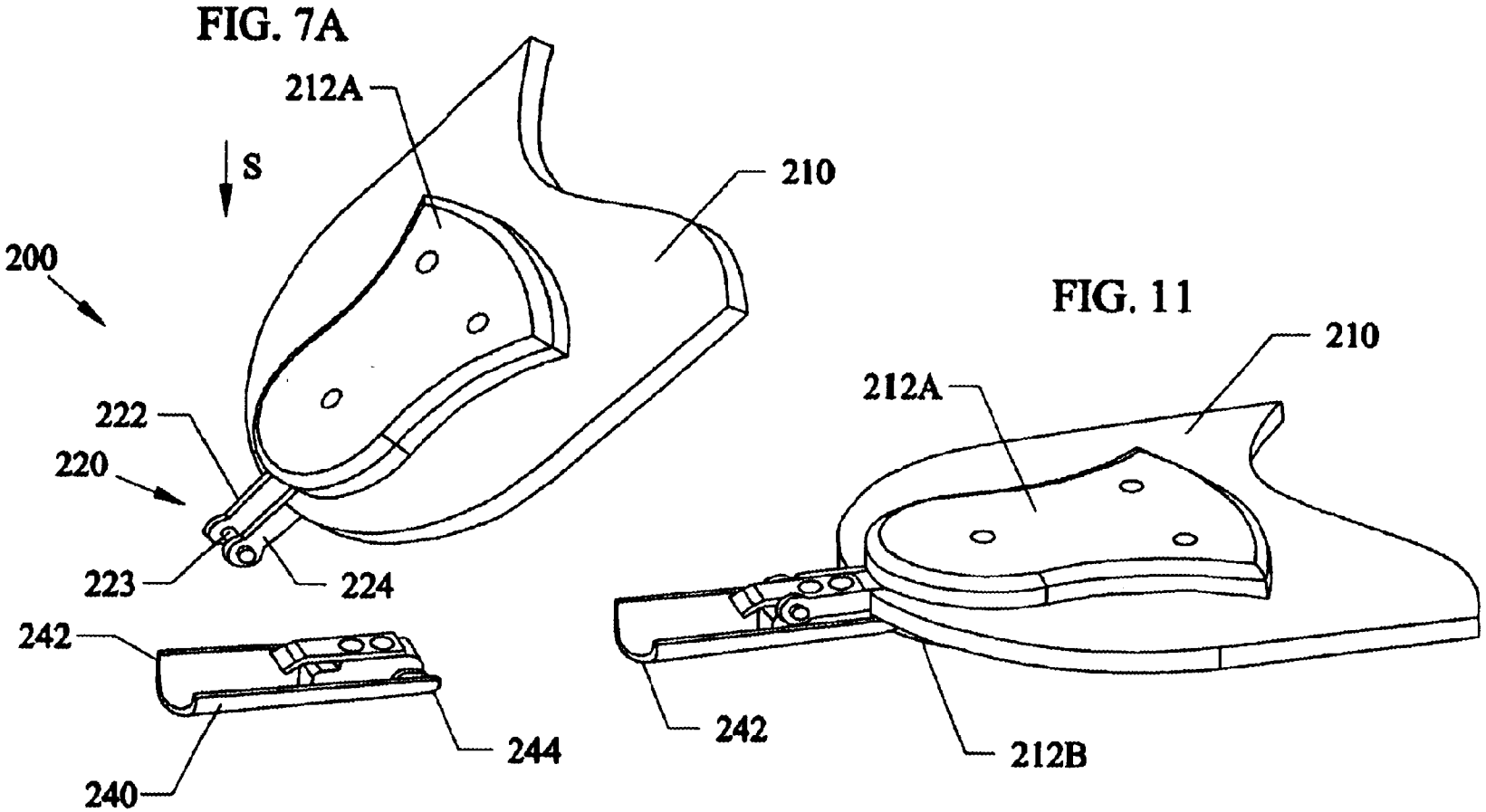
FIG. 7A is a perspective view of a second embodiment of the hook and fold ceiling fan blade with the blade ready to be attached to a motor/arm.
FIG. 11 is a perspective view of the second embodiment in a fully attached state.
Figures 7B, 7C, 8, 9, 10:
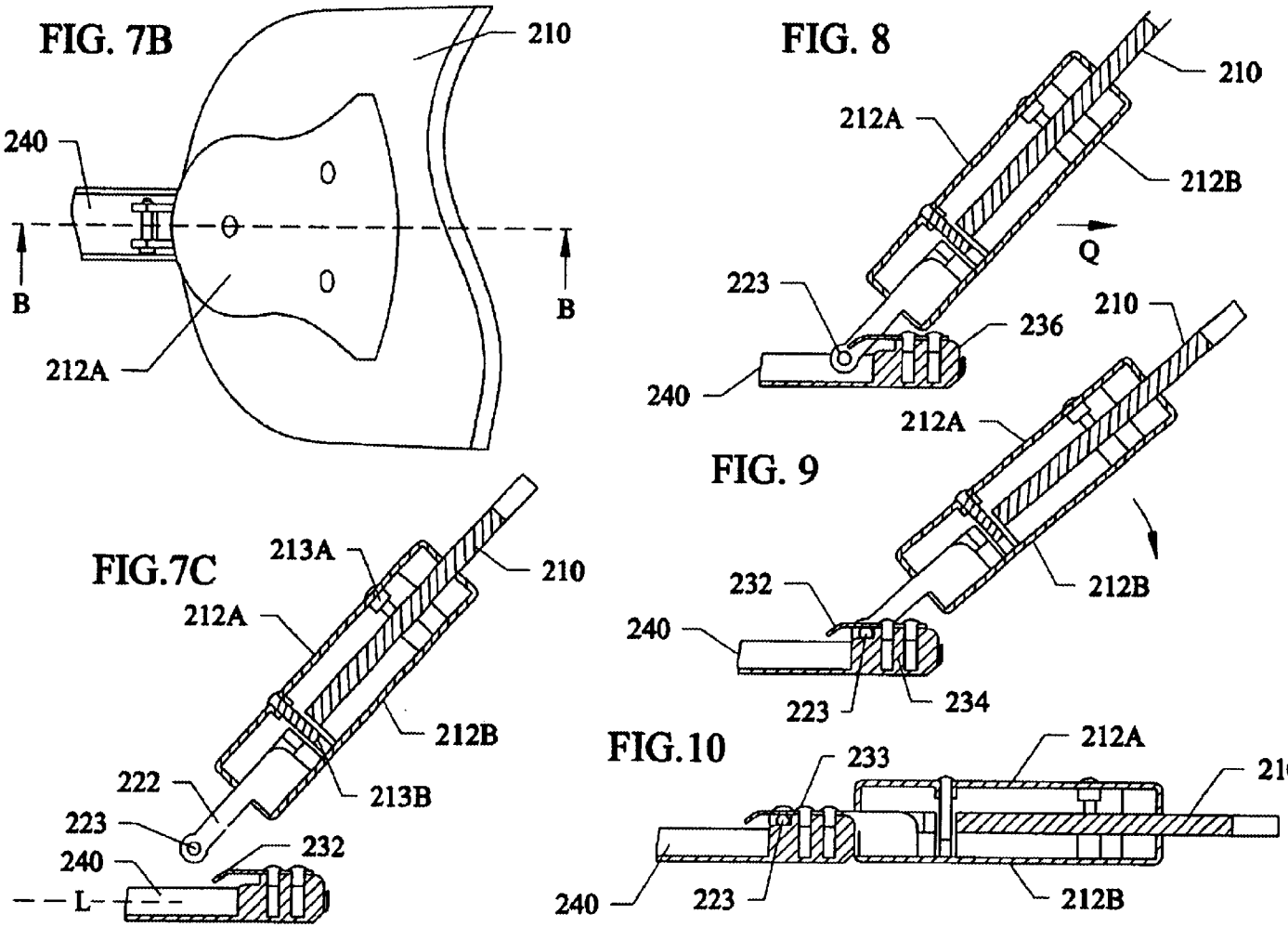
FIG. 7B is a top view of FIG. 7A along arrow S.
FIG. 7C is a side cross-sectional view of FIG. 7B along arrows B—B.
FIG. 8 is another view of FIG. 7C with the hook starting to be inserted about the pin.
FIG. 9 is another view of FIG. 8 with the hook being fully wrapped about the pin.
FIG. 10 is another view of FIG. 9 with the blade in a folded down position.

A second embodiment of the subject invention hook and lock blades will be described in reference to FIGS. 7A–14D. FIG. 7A is a perspective view of a second embodiment 200 of the hook and fold ceiling fan blade invention with the blade 210 ready to be attached to a motor/arm 240. FIG. 7B is a top view of FIG. 7A along arrow S. FIG. 7C is a side cross-sectional view of FIG. 7B along arrows B—B.

Figures 12A, 12B, 12C, 13A, 13B, 13C:
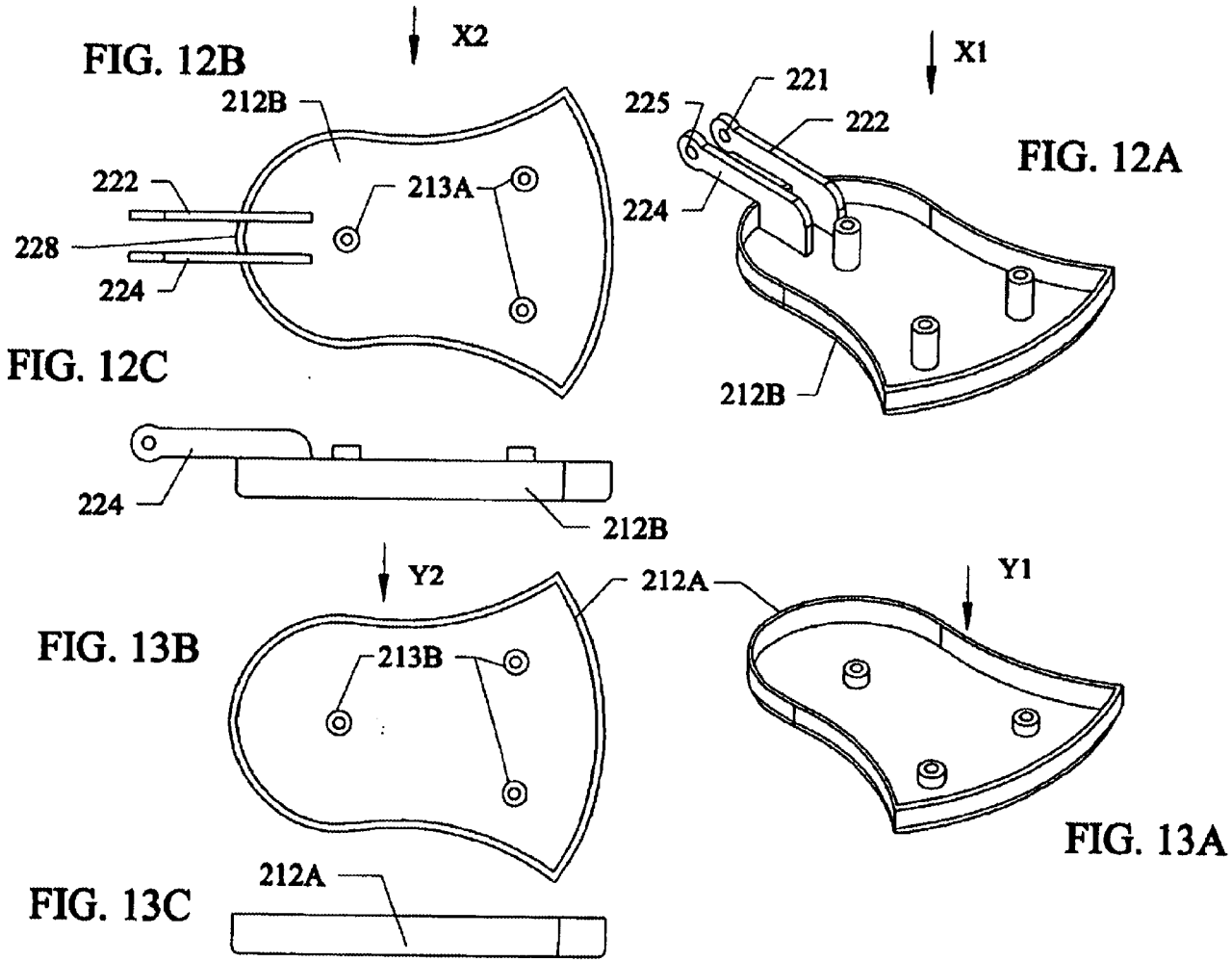
FIG. 12A is a perspective view of the lower medallion cover of the second embodiment.
FIG. 12B is a top view of the cover of FIG. 12A along arrow X1.
FIG. 12C is a side view of the cover of FIG. 12B along arrow X2.
FIG. 13A is a perspective view of the upper medallion cover of FIG. 7A–11 without pin support arms.
FIG. 13B is a top view of the cover of FIG. 13A along arrow Y1.
FIG. 13C is a side view of the cover of FIG. 13B along arrow Y2.

FIG. 12A is a perspective view of the lower medallion cover 212B of the second embodiment 200. FIG. 12B is a top view of the cover 212B of FIG. 12A along arrow X1. FIG. 12C is a side view of the cover 212B of FIG. 12B along arrow X2. Referring to FIGS. 12A–12C, medallion cover 212B can include two arms 222 and 224 attached to and extending from a rear portion so that a rotation pin 223 can be fixably inserted into mounting holes 221, 225 so that pin 223 can be fixably attached to both arms 222 and 224.

FIG. 13A is a perspective view of the upper medallion cover 212A of FIGS. 7A–11 without pin support arms. FIG. 13B is a top view of the cover 212A of FIG. 13A along arrow Y1. FIG. 13C is a side view of the cover 212A of FIG. 13B along arrow Y2.

The upper medallion cover 212A can be attached to the lower medallion cover 212B by positioning and sandwiching both covers 212A and 212B about an end portion of the blade 210 and using snapable type fasteners 213A, 213B, where for example male prong portions 213A can mateably snap into female receivers 213B holding the medallion covers 212A and 212B to blade 210. The two sided medallion covers 212A, 212B allow the second embodiment to be able to reverse the blade 210 during use. Thus, a blade 210 can be used that has different colors(i.e. black on one side and white on other side, wood grain on one side and solid color on other side, and the like)

Figure 14A:
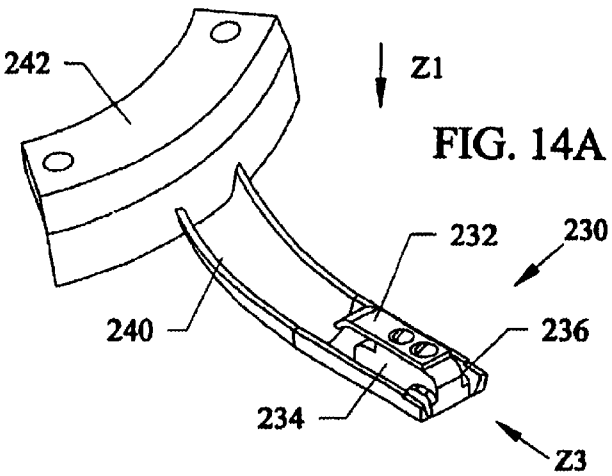
FIG. 14A is a perspective view of the arm and hook connector of the second embodiment.
Figure 14B:
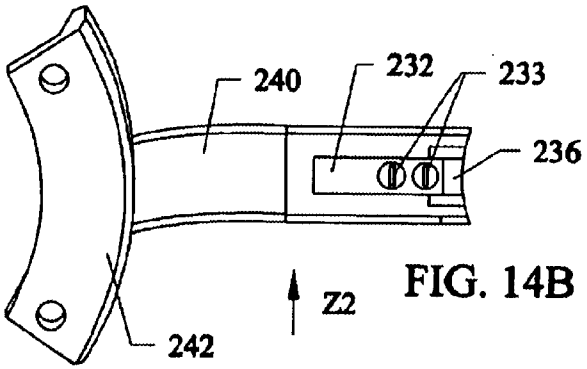
FIG. 14B is atop view of FIG. 14A along arrow Z1.
Figure 14C:
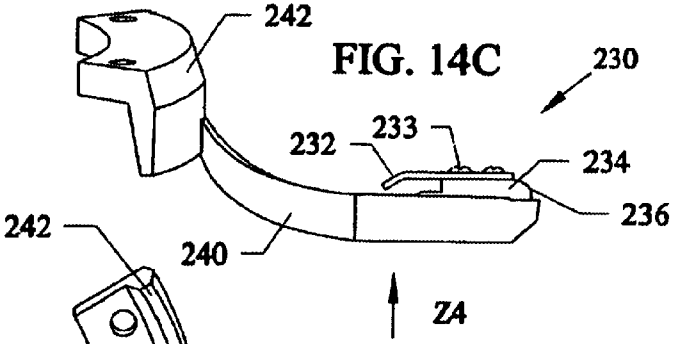
FIG. 14C is a side view of FIG. 14B along arrow Z2.
Figure 14D:
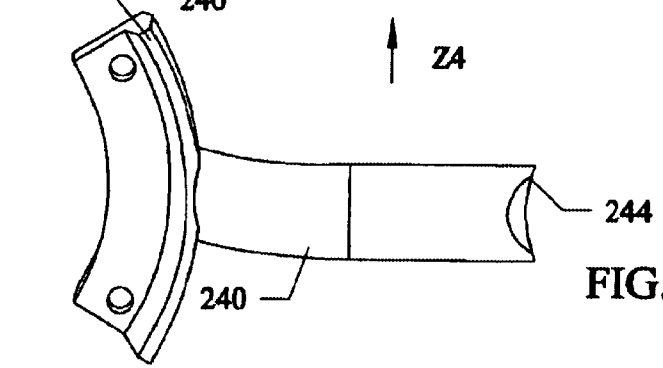
FIG. 14D is a bottom view of FIG. 14C along arrow Z4.

FIG. 14A is a perspective view of the arm 240 and hook connector 230 of the second embodiment 200. FIG. 14B is a top view of FIG. 14A along arrow Z1. FIG. 14C is a side view of FIG. 14B along arrow Z2. FIG. 14D is a bottom view of FIG. 14C along arrow Z4. Referring to FIGS. 14A–14D, hook connector 230 includes a hook portion 232 facing toward the motor end 242 of arm 240, with the hook portion attached by fasteners 233 such as screws and the like, to a narrow raised body portion 234 with a uneven surface 236 facing toward the blades 210. The hook connector 230 can be fixably attached to the arm 240 by being molded into the arm, or attached by conventional fasteners (not shown) such as screws and the like.

The second embodiment 200 of the subject invention can be assembled by initially hanging the ceiling fan motor as shown in FIG. 1, with the blades to be attached thereafter. The method of attaching the blade 210 to the motor/arm 240 of the ceiling fan will be described in reference to FIGS. 7C and 8–10.

An installer can initially orient the blade 210 off axis to the longitudinal axis L, of the motor arm 240. FIG. 8 is another view of FIG. 7C with the hook portion 232 starting to be inserted about the pin 223. Next, the installer can pull or push the blade 210 in the direction of arrow Q so that the hook portion 232 is fully attached. FIG. 9 is another view of FIG. 8 with the hook portion 232 being fully wrapped about the pin 223. Finally, the blade 210 is folded down in the direction of arrow S. FIG. 10 is another view of FIG. 9 with the blade 210 in a folded down position with the blade 210 in the same plane as the axis L of the arm 240. FIG. 11 is a perspective view of the second embodiment 200 in a fully attached state.

Similar to the first embodiment 100, there is at least one locking techniques for locking the blade 210 to the arm 240. The narrow body portion 234 of hook connector 230 slides between and becomes sandwiched in the space between the two arms 222, 224 of connector 220. A tight sized space between arms 222, 224 allows for a tight fit when the narrow body portion 234 of hook connector 230 has been placed therein. The bottom surface 245(shown more clearly in FIG. 14D) on both sides of narrow body portion 234 of hook connector 230 abuts against the bottom of the arms 222, 224 of connector 220 to complete the locking step. Although not shown a second locking technique similar to the one described in reference to the first embodiment can also be used in the second embodiment. For example, a raised ridge and mateable indentation can be on either the rear surface 236 of hook connector 230 and surface 228(FIG. 12B), respectively, and vice versa.

While the preferred embodiments describe attaching ceiling fan blades while the motor has been previously hung on a ceiling, the blades can be attached before the motor is hung so that the entire ceiling fan and blades can be hung together from the ceiling.

Third Embodiment

Figure 15:
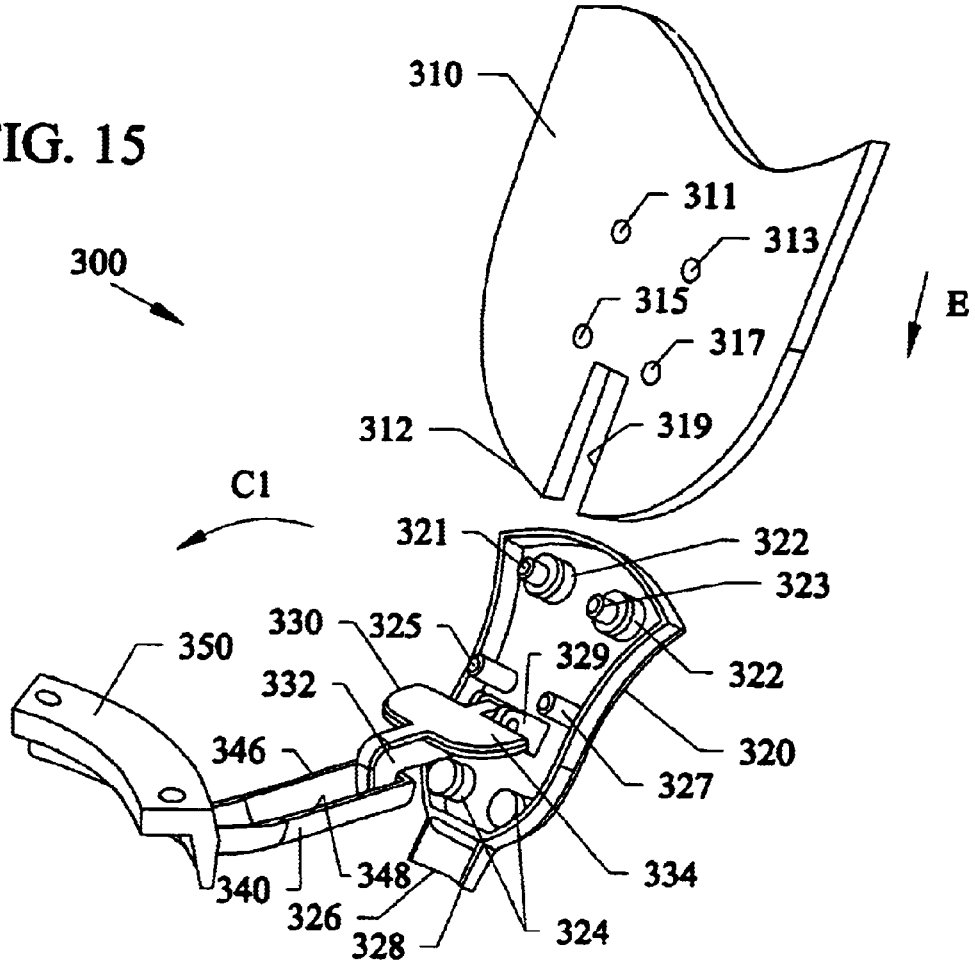
FIG. 15 is a perspective view of a third embodiment having an arm end bent about a hinge, and a blade detached therefrom.

FIG. 15 is a perspective view of a third embodiment 300 having an arm end bent about a hinge, and a blade 310 detached therefrom. Blade 310 can include an inner end portion 312 having a slot 319 therein, and at least one through-hole that passes through the blade 310 from one side to the opposite side. In the preferred embodiment 300, four through-holes 311, 313, 315, 317 are shown. The invention can be practiced with at little as one through-hole, two through holes, three through-holes or more. A medallion portion 320 can be attached to a blade arm 340 by a hinge portion 330, and the arm 340 can be attached to a ceiling fan motor(such as 10 illustrated in FIG. 1) by a rotor mount flange 350. The medallion 320 can include at least one upwardly projecting post type member. Here, four post type members 321, 323, 325, 327 are shown which can be sized to fit within the like positioned respective through-holes 311, 313, 315, 317. About at least one of the post type members can be resilient members 322 such as washers, gaskets, and the like, made from rubber, foam, and the like. Also, additional cushion type resilient pads 324 such as rubber, foam, and the like, can be attached to a portion of the body of the medallion 320. Extending from an inner end of the medallion 320 can be a downwardly protruding member 326 that can have sides 328 that form a channel type groove therebetween. Hinge portion 330 can include an upwardly bent narrow width L-portion 332, a wide flange portion 334, and a narrow width tip portion 336, which is hingedly connected to upwardly projecting hinge post(s) 329 attached to the medallion 320.

Figure 16:
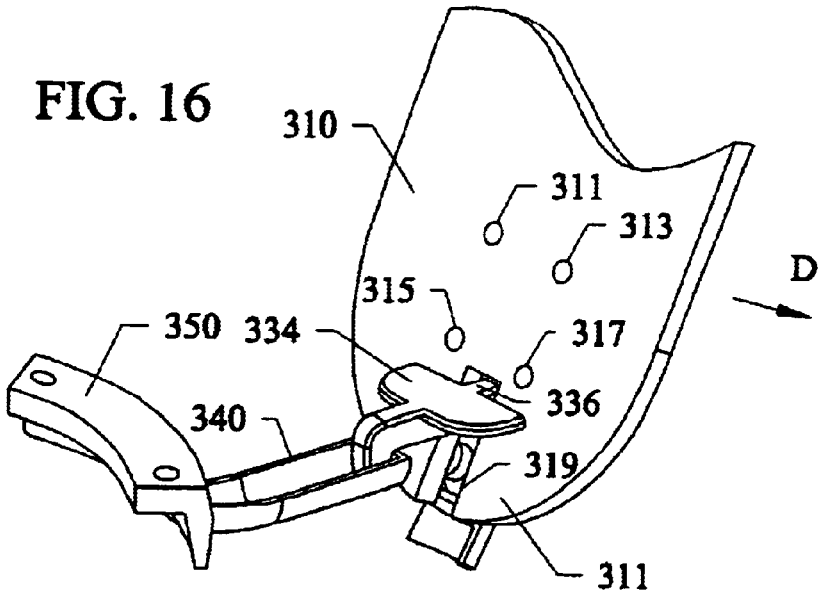
FIG. 16 is another view of the third embodiment having the blade end inserted into the space formed between the bent arm end and the blade arm.

For the assembly, medallion 320 can be bent upward about hinge 330 in the direction of arrow C1 to an angle of approximately 10 to approximately 90 degrees, here approximately 50 degrees creating a space between wide flange wing type portions 334 and the medallion 320. Next, blade 310 can be moved downward in the direction of arrow E so that slot 319 fits about narrow width tip portion 336. FIG. 16 is another view of the third embodiment 300 having the blade end inserted into the space formed between the bent arm end and the blade arm.

Figure 17:
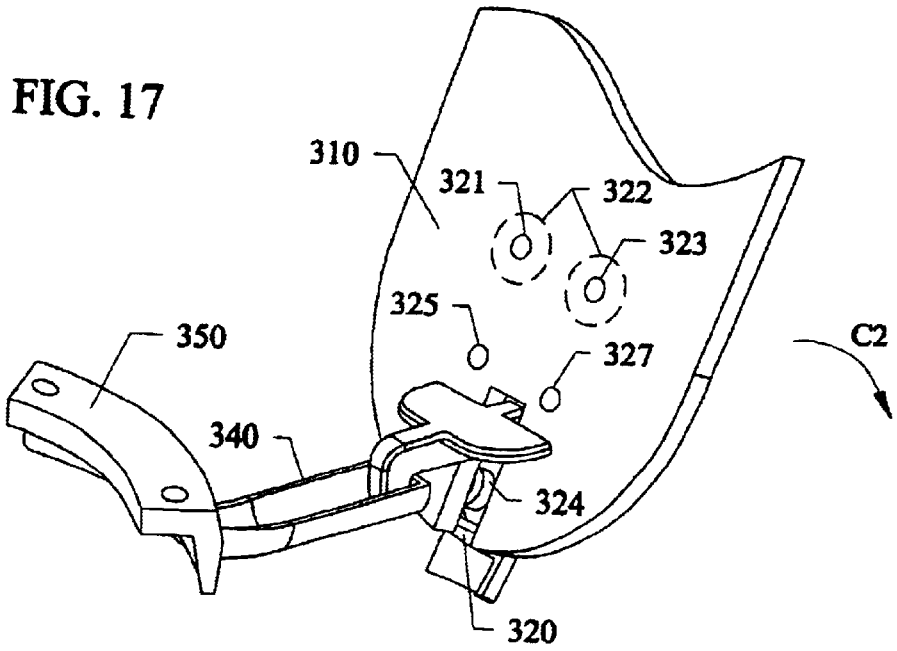
FIG. 17 shows the blade end hooked over the raised posts of the bent blade end.

Next, blade 310 and medallion 320 can be moved substantially laterally in the direction of arrow D allowing for the post type members 321, 322, 325, 327 of the medallion 320 to hook into the respective through-holes 311, 313, 315, 317 of the blade 310. The post type members allow for the blade 310 to be instantly aligned into position with the arm 340. FIG. 17 shows the blade 310 hooked over the raised posts 321, 323, 325, 327 of the medallion 320, with the resilient type members 322, 324 sandwiched between the blade 310 and the medallion 320.

Figure 18:
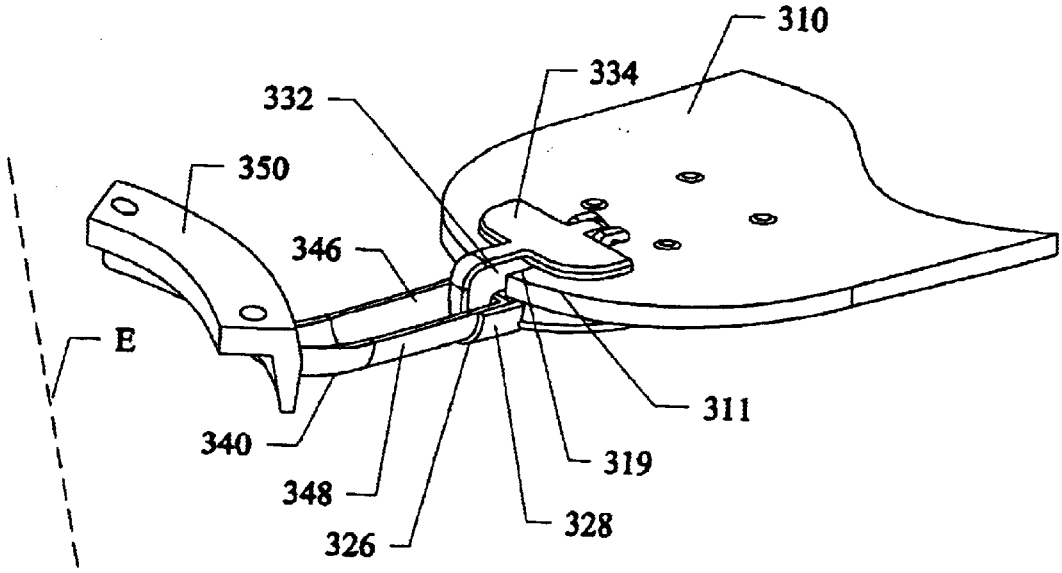
FIG. 18 is a final assembly view of the blade end sandwiched between the blade arm end and a portion of the hinge.

Finally, the blade 310 is folded downward in the direction of arrow C2 until the blade 310 and arm 340 are substantially perpendicular to the rotational axis E of the motor (such as the one shown in FIG. 1). In the final fold down position, the sides 346, 348 of the arm 340 are within the channel formed from the sides 328 of the protruding member 326 attached to the medallion 320. Additionally, the flange wings 334 of the upper portion of the hinge abut against portions 311 of the blade 310 further locking the blade 310 to the arm 340. Furthermore, the locking can include a portion of bent narrow width L-portion 332 fitting within slot 319 of the blade 310. In the lock down position shown in FIG. 18, both lateral and vertical movement of the blade relative to the arm is substantially eliminated.

The blades 310 and arms 340 and other shown components can be made from plastic, wood, metal, other suitable materials, combinations, thereof, and the like.

Although four posts 321, 323, 325, 327 and four mateable through-holes 311, 313, 315, 317 are shown, the invention can be practiced with one post and one through-hole, two posts and two through-holes, three posts and three through-holes, or more. The post(s) and through-hole(s) allows for an alignment fit between the blade 310 and the arm 340 along with the slot 319 that fits about the narrow width L-portion 332 While the post(s) and through-hole(s) appear to be cylindrical in the drawings, they can include other shapes such as but not limited to rectangular, oval, different shapes, combinations thereof, and the like. Additionally, any of the post(s) and mateable through-hole(s) can be a tight fit that allows a lock there between.

While the post(s) are shown projecting upward from the medallion 320, the posts can project in other directions, such as but not limited to downward, for example if the medallion is on top of the blades. Additionally, the posts can be located on other components such as but not limited to the flange wings 334 of the hinge portion 330, on the protruding portion 326 of the medallion, and the like.

Although resilient washers/gaskets 322 are shown on two posts 321, 323, the washers/gaskets can be used on only one post, three posts, and all four posts shown. Additionally, the cushion(s)/pad(s) 324 can be eliminated or used in combination with the washer(s)/gasket(s) 322, or used without the washer(s)/gasket(s) 322. Additionally, the cushion(s)/pad(s) 324 can be a single one or more than one, and additionally, the cushion(s)/pad(s) 324 can be located in different locations on the medallion 320. Furthermore, the cushion(s)/pad (s) 324 and/or washer(s)/gasket(s) 322 can be initially located and/or attached to the blade 310 instead of the medallion 320. Furthermore, the undersurface of the flange wings 334 and/or a portion of the upper surface 311 of the blade can use cushion(s)/pad(s) 324 for vibration and noise reduction effects. Still furthermore, the inside of the slot 319 and/or the sides of the narrow width L-portion 332 and/or the sides 346/348 of the arm 340 and/or protruding member 326 and/or sides 328 can include cushion(s)/pad(s) 324 as needed. The invention would contemplate any area where there is potential contact between components to have one or more cushion(s)/pad(s) 324 and/or washer(s)/gasket(s) 322 singularly or in any combination.

Still furthermore, the invention can be practiced without vibration reduction washer(s) 322 and cushion(s)/pad(s) 324, for example when there are tight fits between the post(s) and through-hole(s), and/or between the slot 319 and hinge portion 322 and/or between the arm 340 and protruding member 326, 328.

Although the third embodiment can be used with a motor that is pre-hung from a ceiling as shown in FIG. 1, the invention can be easily practiced by installing the blade(s) 310 onto the arm(s) 340 that are attached to the motor, before hanging the motor from the ceiling.

The third embodiment allows for less assembly steps by allowing for the blade(s) to be pre-installed onto the arm(s) 340 or the motor at a factory, and in the bent position shown in FIG. 17 be further bent so that the blade(s) 310 are at a substantial ninety degree bent angle and packaged in a way similar to that shown and described in U.S. Pat. No. 6,213,716 to the same inventors and assignee as the subject invention, which is incorporated by reference. Also, the blade(s) 310 could be packed separated from the arm(s) 340 and/or fan motor in a packing box such as done in many conventional ceiling fan packages.

Fourth Embodiment

Figure 19A:
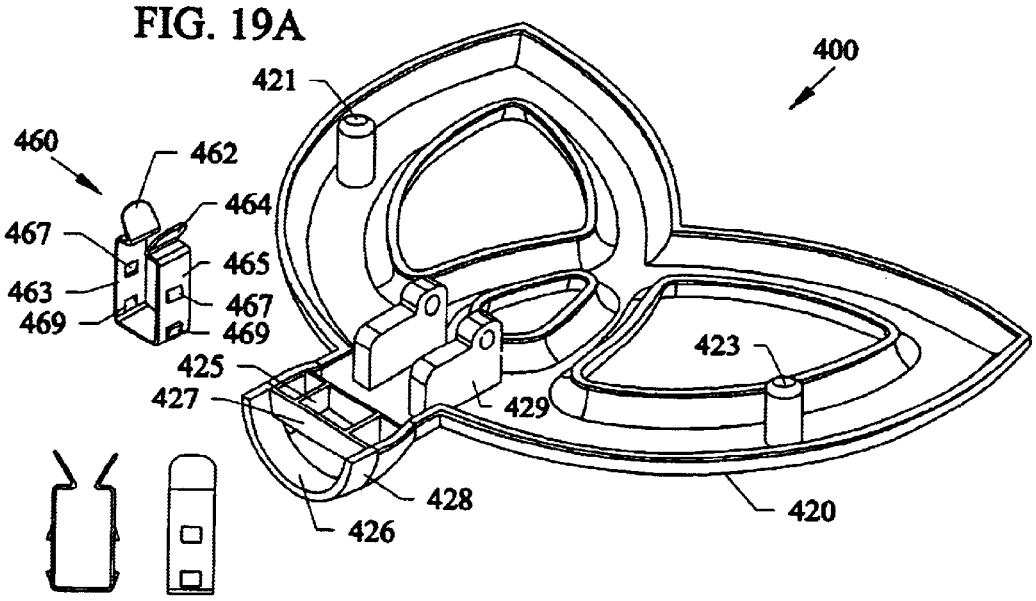
FIG. 19A is an exploded perspective view of a fourth embodiment medallion and spring clip.
Figure 19B:
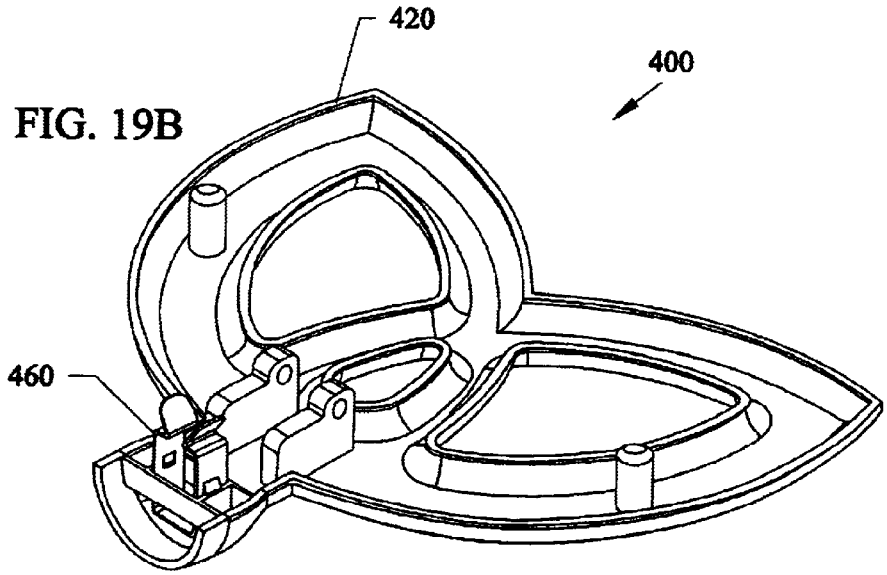
FIG. 19B is another perspective view of FIG. 19A with spring clip attached to the medallion.

FIG. 19A is an exploded perspective view of a fourth embodiment 400 of a medallion 420 and spring clip 460. FIG. 19B is another perspective view of FIG. 19A with spring clip 460 attached to the medallion 420.

Similar to the medallion 320 of the third embodiment, the fourth embodiment medallion 420 can include at post type member(s) 421, 423. Hinge post(s) 429 are also attached to a portion of medallion 420, and a protruding member 426 extends off one end of medallion 420 with sides 429 forming a channel therebetween, and a grill member 427 extends across the sides 428 which can receive legs 463, 465 of spring clip 460. A pair of punched out interior facing tabs 469(such as dimples) in the lower portions of spring clip legs 463, 465 allow the clip 460 to be locked inside the opening 425 of the grill member 427.

Figure 20:
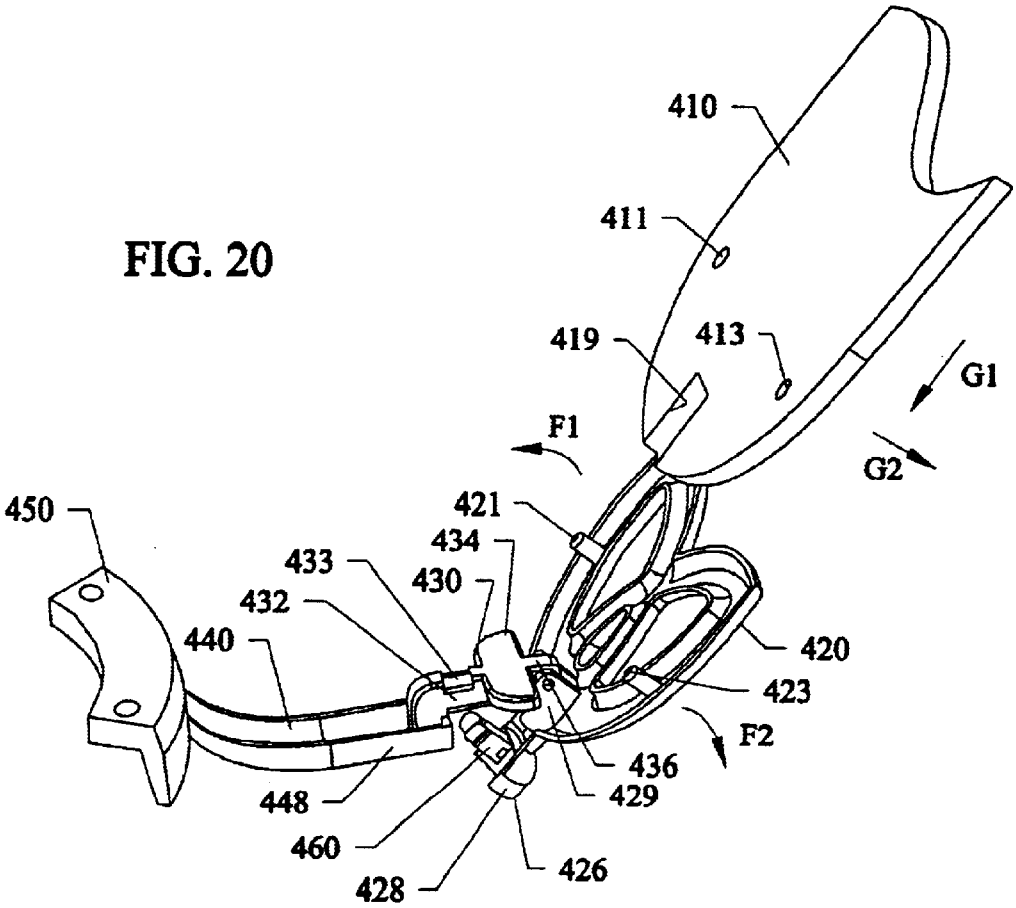
FIG. 20 shows a blade end ready to slide in and hook onto the medallion of FIGS. 19A–19B.

FIG. 20 shows a blade end 410 ready to slide in and hook onto the medallion 420 of FIGS. 19A–19B. Similar to the third embodiment, hinge posts 429 rotatably attach medallion 420 to blade arm 440 by a hinge portion 430.

For the assembly, medallion 420 can be bent upward about hinge 430 in the direction of arrow F1 to an angle of approximately 10 to approximately 90 degrees, here approximately 50 degrees creating a space between wide flange wing type portions 434 and medallion 420. Next, blade 410 can be moved downward in the direction of arrow G1 so that slot 419 of blade 410 fits about a narrow width tip portion 436. Next, blade 410 with medallion 420 can be moved substantially in a lateral direction of arrow G2 allowing the post type members 421, 423 of the medallion 420 to hook into the respective through-holes 411, 413 of the blade 410. Similar to the third embodiment, the blade 410 and medallion 420 can be folded downward in the direction of arrow G2.

Figure 21:
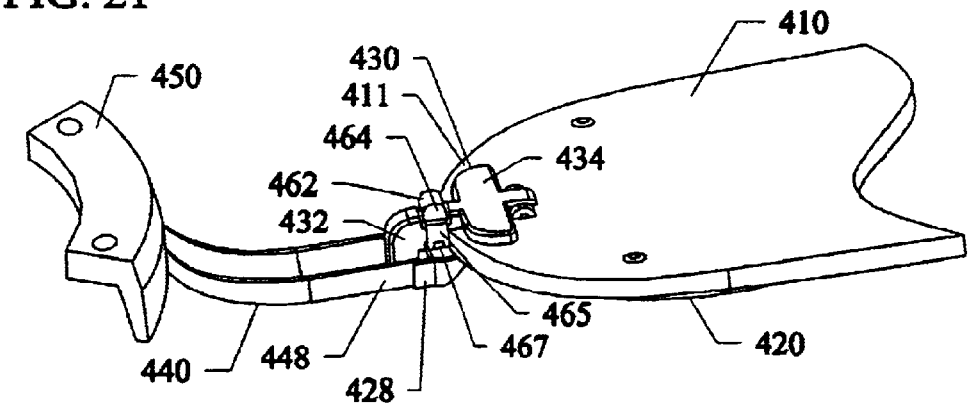
FIG. 21 is a final assembly view of the blade end sandwiched between the blade arm end and a portion of the arm connected hinge.

FIG. 21 is a final assembly view of an end portion 411 of the blade end 410 sandwiched between the medallion 420 and a wing flange portions 434 of the hinge 430. Similar to the third embodiment, channel space between sides 428 of protruding portion 426 wrap about sides 448 of arm 440 that is can be previously attached to a ceiling fan motor(such as 10 illustrated in FIG. 1) by a rotor mount flange 450.

In FIG. 21, the bent tab ends 462, 464 of the spring clip 460 wrap about narrow width portion 432 of the hinge portion 430 and can press into side indentations 433 thereon, along with a pair of punched out interior facing tabs 467 (shown also in FIG. 19A) in the upper portions of spring clip legs 463, 465 allow the clip 460 to be locked to narrow width portion 432 of the hinge portion 430 that is pre-connected to arm 440, further locking the blade 410 to the arm 440.

The blades 410 and arms 440, and spring clip 460, and other shown components can be made from plastic, wood, metal, other suitable materials, combinations, thereof, and the like.

Although, the fourth embodiment shows protruding sides 428 of medallion 420 gripping about arm 440 along with spring type clip 460, the invention can be practiced without the wrapping about sides 428.

Although, the spring clip 460 is shown having two bent tab ends 462, 464 with two legs 463, 465, with two pairs of pressed type dimpled tabs 467, 469, the invention can be practiced with one bent tab end or more, one or more legs, no dimpled tabs, one dimpled tab, or more dimpled tabs, as needed.

Although the clip 460 is shown as being initially attached to the medallion 420, the clip 460 can be attached to portions of the arm 440, and the like. Still additionally, the clip 460 can be attached to portions of the hinge portion 430 such as but not limited to the narrow portion 432. Still additionally, the clip can have tab end(s) facing downward, sideways, and the like.

The fourth embodiment can also be used without a spring clip. For example, the post(s) can be longer, so that the far exterior end of the blades in relation to the pivot(hinge typed portion)point allows the weight of the blades to hold the blades both perpendicular to the rotational axis of the motor, and stable to the motor housing.

Although two posts 421, 423, and two mateable through-holes 411, 413, are shown, the invention can be practiced with one post and one through-hole, two posts and two through-holes, three posts and three through-holes, or more. The post(s) and through-hole(s) allows for an alignment fit between the blade 410 and the arm 440 along with the slot 419 that fits about the narrow width L-portion 432 While the post(s) and through-hole(s) appear to be cylindrical in the drawings, they can include other shapes such as but not limited to rectangular, oval, different shapes, combinations thereof, and the like. Additionally, any of the post(s) and mateable through-hole(s) can be a tight fit that allows a lock there between.

While the post(s) are shown projecting upward from the medallion 420, the posts can project in other directions, such as but not limited to downward, for example if the medallion is on top of the blades. Additionally, the posts can be located on other components such as but not limited to the flange wings 434 of the hinge portion 430, on the protruding portion 426 of the medallion, and the like.

Although no resilient washers/gaskets and cushion(s)/pad(s) are not shown they can be added as described in previous embodiments. The invention would contemplate any area where there is potential contact between components to could potentially have one or more cushion(s)/pad(s) and/or washer(s)/gasket(s) singularly or in any combination.

The invention can be used when there are tight fits between the post(s) and through-hole(s), and/or between the slot 419 and hinge portion 422 and/or between the arm 440 and protruding member 426.

Although the fourth embodiment can be used with a motor that is pre-hung from a ceiling as shown in FIG. 1, the invention can be easily practiced by installing the blade(s) 410 onto the arm(s) 440 that are attached to the motor, before hanging the motor from the ceiling.

The fourth embodiment allows for less assembly steps by allowing for the blade(s) 410 to be pre-installed onto the arm(s) 440 or the motor at a factory, and in the bent position shown in FIG. 20 be further bent so that the blade(s) 410 are at a substantial ninety degree bent angle and packaged in a way similar to that shown and described in U.S. Pat. No. 6,213,716 to the same inventors and assignee as the subject invention, which is incorporated by reference. Also, the blade(s) 410 could be packed separated from the arm(s) 440 and/or fan motor in a packing box such as done in many conventional ceiling fan packages.

Fifth Embodiment

Figure 22:
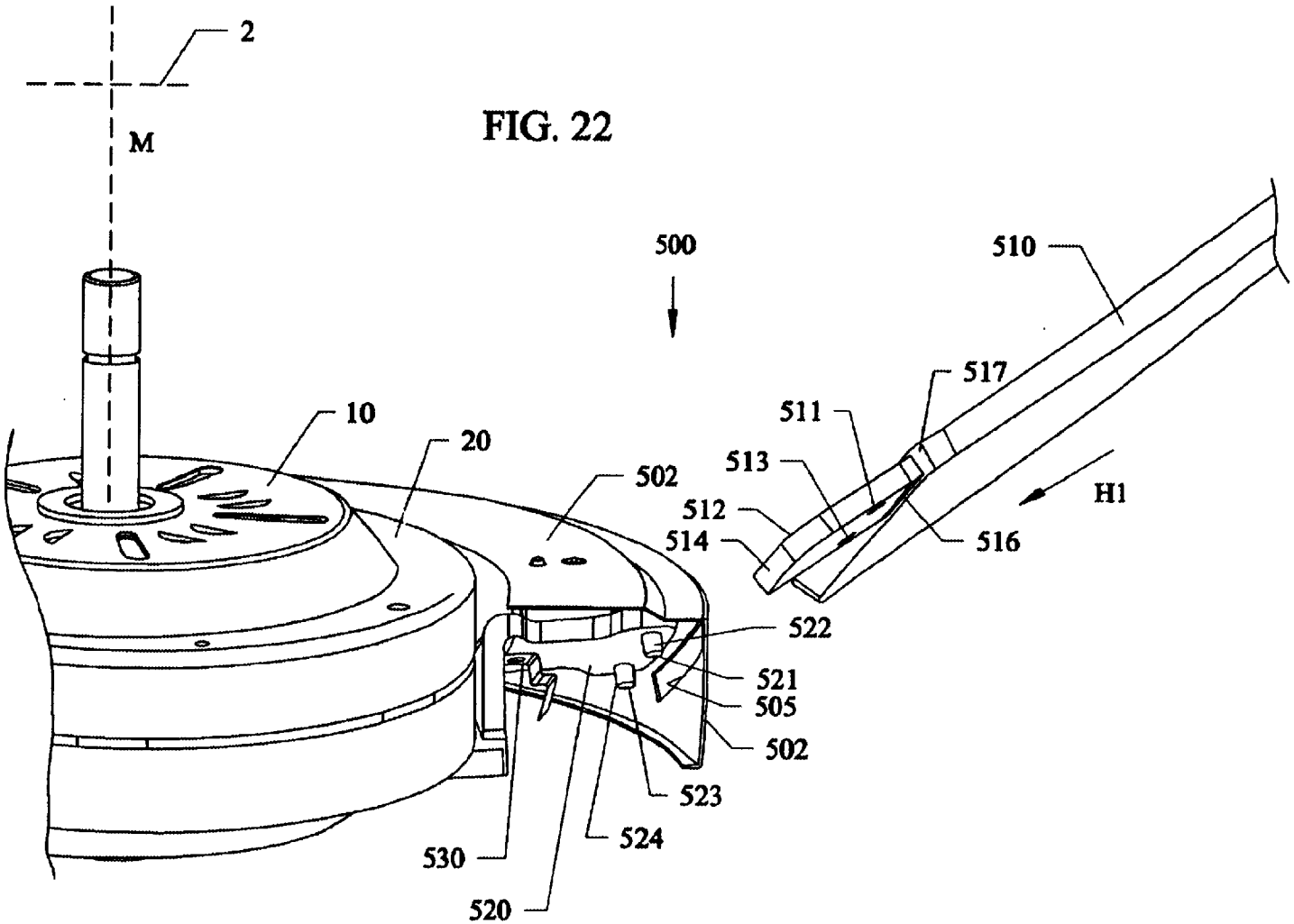
FIG. 22 is an exploded perspective view of a fifth embodiment of a blade and partial cut-away view of the rotating band of the ceiling fan motor showing the post(s) and clip.

FIG. 22 is an exploded perspective view of a fifth embodiment 500 of a blade 310 and partial cut-away view of the rotating band 502 of the ceiling fan motor 10(similar to that shown in FIG. 1) showing the novel post(s) 521–524 and novel clip 530. Blade 510 can include an inwardly protruding end portion 512 having through-holes 511, 513 therethrough. Motor 10 can include a rotating rotor portion 20 similar to that shown in the prior art of FIG. 1. Attached about the rotor 20 can be a rotating band 502 having narrow rectangular typed shaped slot(s) 505 in the perimeter thereof. Although only one is shown, other slots can exist about the band 502 for other blade ends to be similarly inserted therethrough. Attached to the rotor 20 can be a flange arm 520. The flange arm 520 can be in a plane perpendicular to the rotational axis M of the motor 10. Additionally, the flange arm 520 and/or the protruding blade end 512 can be slightly twisted in order to allow for the blade to mounted at a slight twist angle to increase air flow. Extending downward from the flange arm 520 can be posts 521, 523 each with resilient type washers/gaskets 522, 524 thereon, that were similarly described in reference to the other embodiments.

For the assembly, motor 10 can be either pre-hung to a ceiling 2(see FIG. 1) prior to having the blade(s) 310 attached thereto, or have the blades 310 attached before hanging the ceiling fan to the ceiling inner blade end 512, 514 can be moved downward at an angle of approximately 10 to approximately 80 degrees in the direction of arrow H1 through side slot 505 in band 502.

Figure 23:
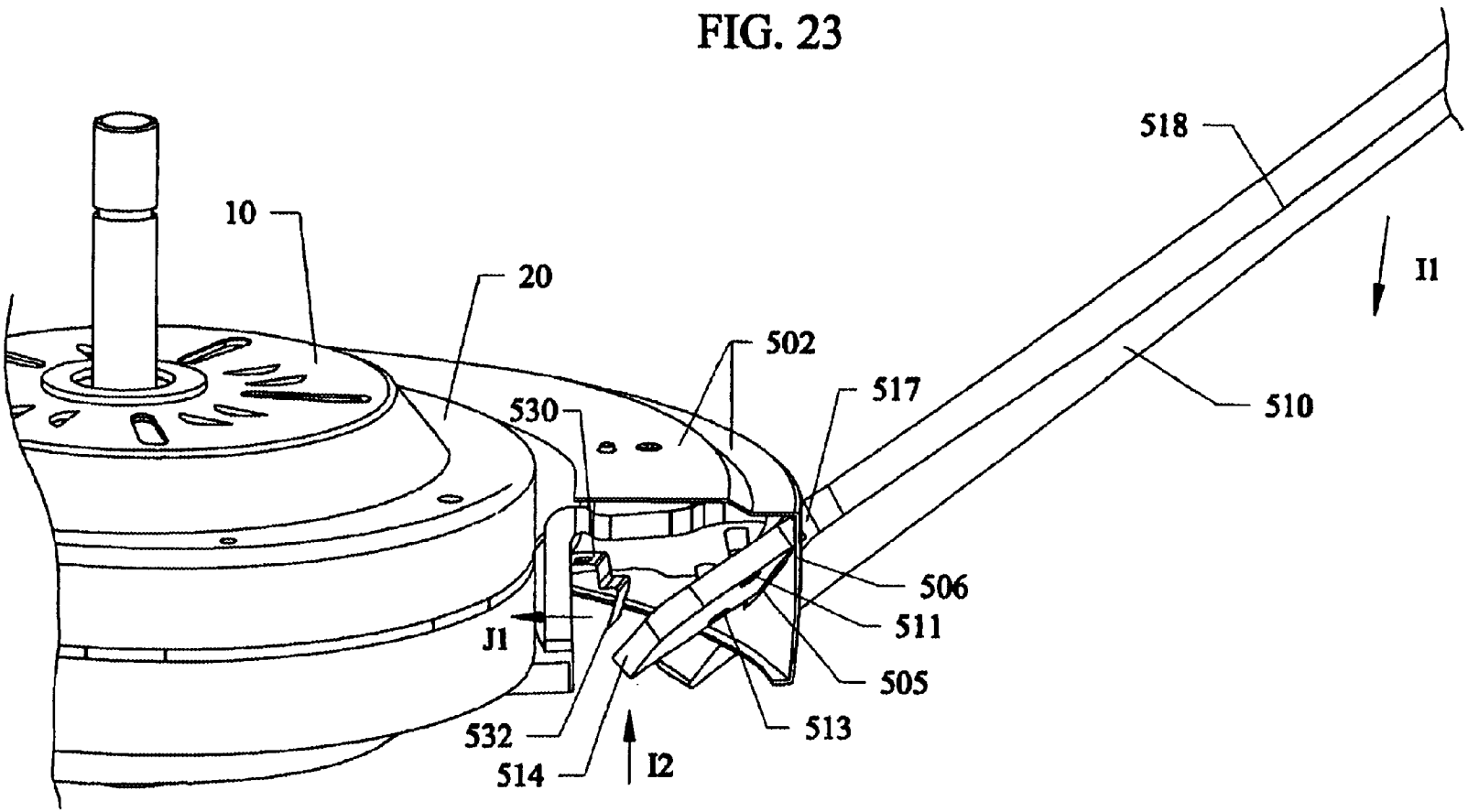
FIG. 23 is another view of FIG. 22 with the blade slid into a slot in the rotating band of the motor.

FIG. 23 is another view of FIG. 22 with the blade end 512 slid into slot 505 in the rotating band 502 of the motor 10 until a shoulder portion 517 of the blade adjacent to a portion 516 of protruding end 512 abuts against an outer edge 506 of the motor band 502. Next, outer blade portion 518 of blade 510 is moved downward in the direction of arrow I1 while pivoting about the slot 505, while inner blade end 514 moves upward in the direction of arrow I2. As blade end 514 touches inwardly bent tab end 532 of spring clip 530, the tab end 532 can bend inward in the direction of arrow J1. While end 514 is rising, the through-holes 511, 513 become hooked about posts 521, 523.

Figure 24:
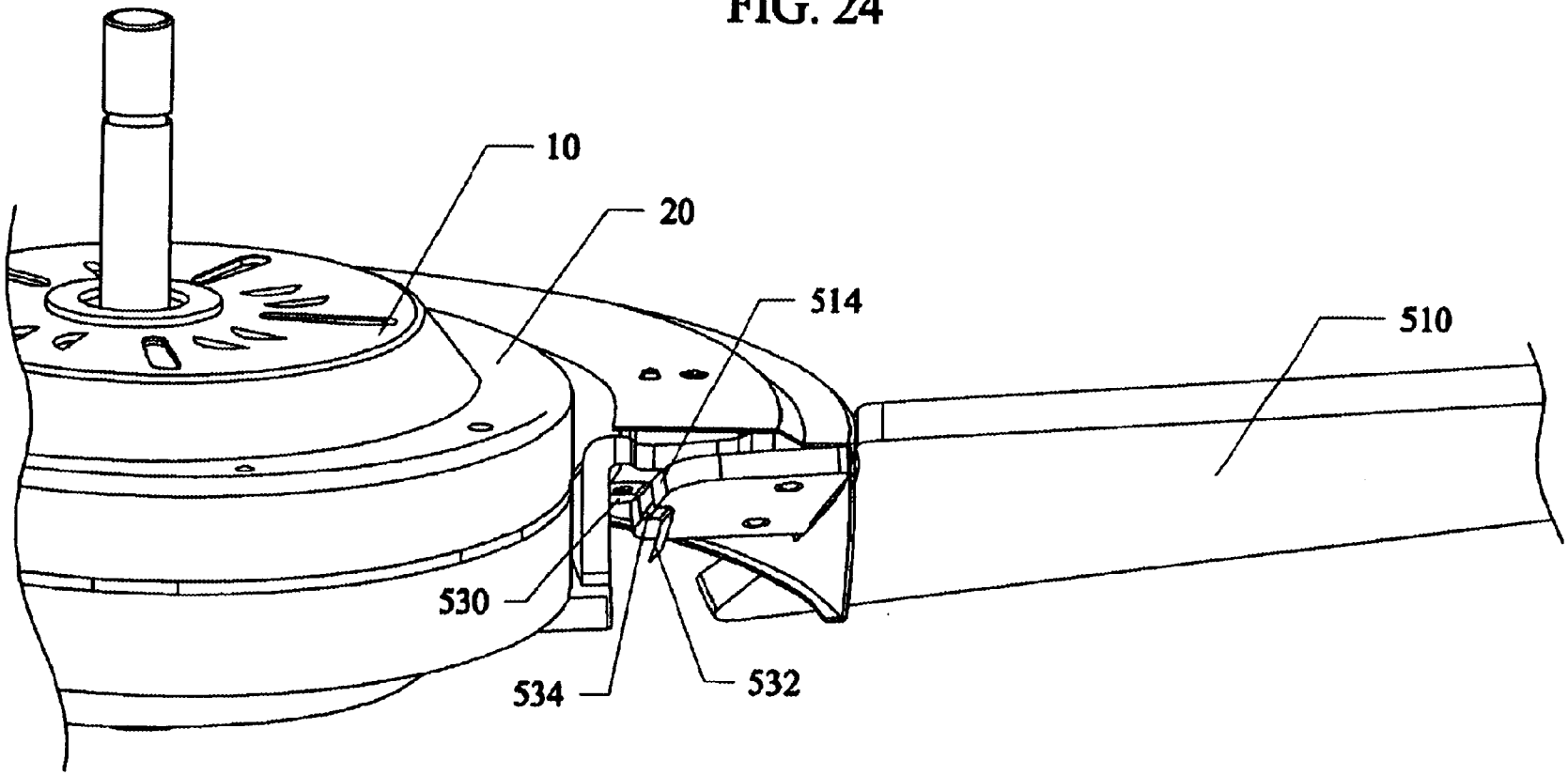
FIG. 24 shows the blade end pivoted about the slot and attached to the spring clip.

FIG. 24 shows a final assembly view of the blade end 514 after being pivoted about the slot 505 and attached to the spring clip 530. Here, the step portion 534 of the clip 530 is now bent about and abuts to end 514 of the protruding end 512 of the blade 510. In FIG. 24, blade 510 is shown in a completely folded out position being substantially perpendicular to the rotating axis of motor 10.

Since the overall weight of the blade 310 is to the side of the pivot point 505 opposite where the blade end 512 attaches to the motor 20, then gravity will continuously pull the blade 510 downward so that the blade end constantly abuts against the motor mount. Thus, this embodiment allows for the gravity of the blade 510 to further lock and hold the blade 510 to the ceiling fan. Similar to all of the preceding embodiments, centrifugal force from the operation of running and spinning the blade(s) 510 allows the blade(s) 510 to be held in place to the ceiling fan.

Figure 25:
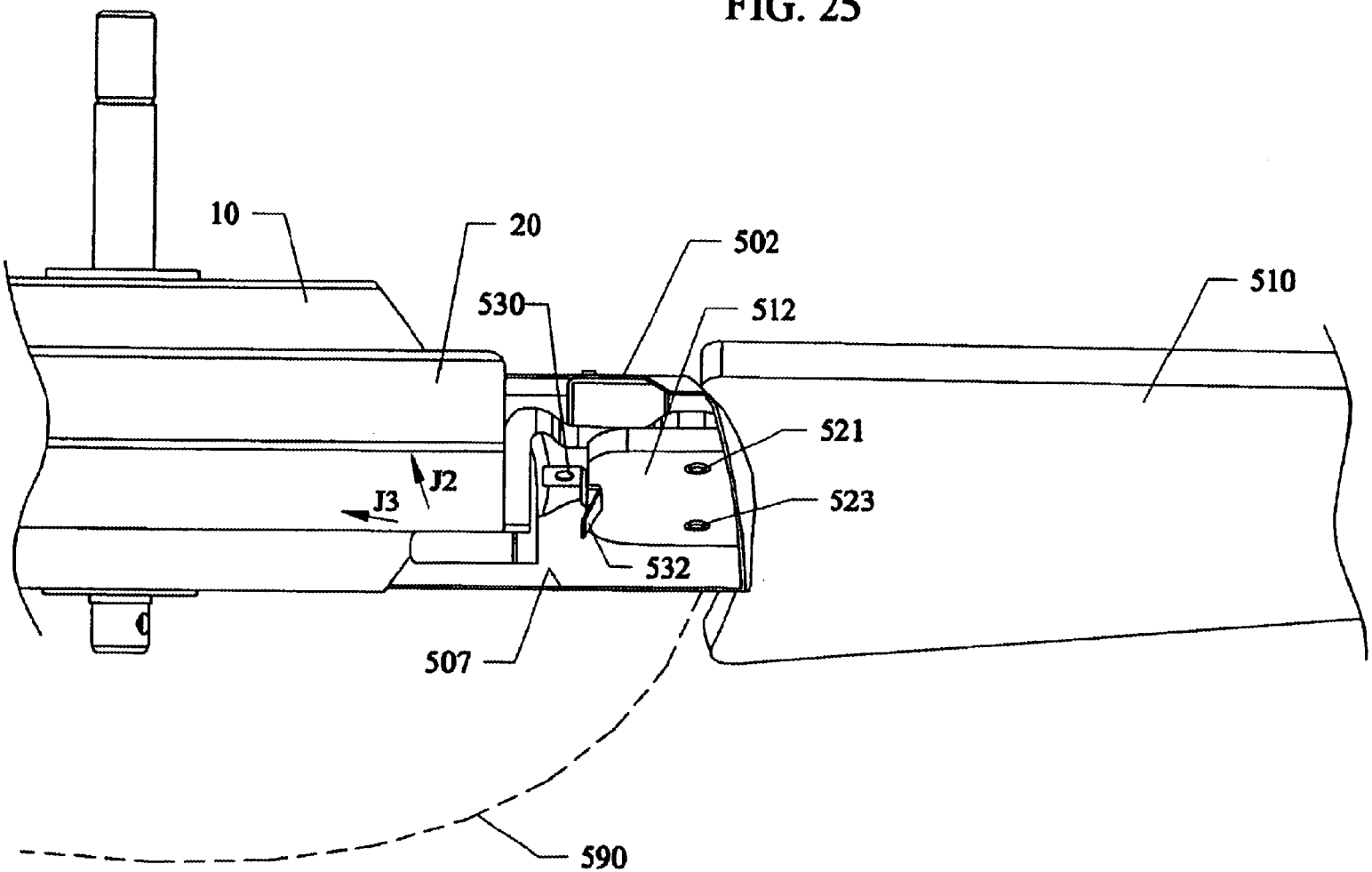
FIG. 25 is a side view of FIG. 24 showing the blade hooked about the post(s) and attached to the clip.

FIG. 25 is a side view of FIG. 24 showing the blade 510 hooked about the post(s) and attached to the clip. With the bottom 507 exposed, the end tab 532 on the springs can be manually moved and/or depressed in the directions of J2 and/or J3 to release the blades. For example, a traditional light kit 590 or bottom housing cover 590 can be used cover the bottom opening 507 that is used to access the clip 530.

Although the invention shows a fan blade to be hooked while it is oriented at an angle of approximately 90 degrees or less to the rotational axis of the ceiling fan motor, the invention can allow for initially positioning the blade at greater than approximately 90 degrees to the rotational axis of the ceiling fan motor.

Although the clip 530 is described as a spring type clip, other types of clips and/or catches and/or clamps can be used. Additionally, the clip can be located on the side edge of the protruding member 512 instead of the end edge 514. Still furthermore, more than one clip can be used, or no clips can be used. Still furthermore, the clip can include a post type portion that passes into a through-hole on the blade end. Still furthermore, the clip can be initially attached to the blade. Still furthermore, the post(s) can initially project from the blade end.

The clip and/or post can be used to restrict lateral and vertical movement, as well as reduce vibration and noise between the blade and the ceiling fan motor.

Although, the post(s) are shown as protruding downward, the invention can be practiced with the post(s) protruding in other directions such as but not limited to upward.

Although two posts and through-holes were shown in the fifth embodiment, the invention can be practiced with one post, three posts or more, and a like number of through-holes.

Additionally, resilient type cushion(s)/pad(s) such as those used in the previous embodiments can be used with or as a substitute for the washer(s)/gasket(s). The invention would contemplate any area where there is potential contact between components to have one or more cushion(s)/pad(s) and/or washer(s)/gasket(s) singularly or in any combination, such as but not limited to the surfaces of the clip 530, slot 505, and the like. Still furthermore, the invention can be practiced without both washer(s)/gasket(s) and cushion(s)/pad(s).

Still furthermore, the invention can be practiced without vibration reduction washer(s) and cushion(s)/pad(s), for example when there are tight fits between the post(s) and through-hole(s), and/or between the clip 530 and the blade end 514.

The fifth embodiment can also be similarly packaged in ways similar to those described in the other embodiments.

In all of the embodiments, the blades can be removed from the arms and motors after the motor has been hung by merely reversing the installation steps described above. For example, if a user wants to remove any blade for cleaning and/or for reversing the blade to show another decorative side of the blade, the embodiments allow for the user to easily remove the blades without having to take down the entire ceiling hung motor.

Still furthermore, unlike much of the prior art the centrifugal force of the spinning blades in any of the above embodiments further locks the blades the arms and motors.

Although the above preferred embodiments show the arms of the motor having hook connectors thereon, the rotating portion of the motor such as the rotor can have the hook connectors thereon instead of the arms. Still additionally, the blade ends can have the hook connectors thereon. Still additionally, a portion of the blades can protrude therefrom with hook connectors. Still additionally, the lock connectors can located on portions of the rotor adjacent to the motor, the lock connectors can be located on the blade ends, and on protruding portions of the blades. Additionally, the hook and lock members can be integrated to be inside of the edges of the rotor, inside of the outer edges of the blade, and the like.

Although some of the preferred embodiments show the hook and lock connectors on the upper surface portions of the blades and arms, the hook and loop connectors can be positioned on the sides of these components, or on the bottom of these components, as needed.

While the locking techniques are shown with one component on one member and another component on another member, the component locations can be switched and their locations can be varied as desired and needed for the particular application used.

Additionally, the hook and lock blades can be easily removed by reversing any of the assembly steps described in reference to the embodiments described above.

Although some of the hook connectors and lock connectors are shown as being formed from separate piece components, the hook and lock connectors can include less and more components, and also be formed from injection molded plastic and the like, where the components are formed with the rotors or the arms or the blades or on protruding portions of the blades, and the like. For example, although some fasteners are shown for some of the pre-attached components in the preceding figures, some or all of these fasteners can be eliminated as needed by techniques such as injection molded plastics, and the like.

The subject invention can also be packed and stored in similar boxes and packaging as U.S. Pat. No. 6,213,716 to Bucher et al., the same assignees and inventors as that of the subject invention, which is incorporated by reference. For example, the blades of the subject invention can be stored vertically with their interior ends adjacent to the rotor/motor of the ceiling fans. Additionally, the subject invention fan blades can be laid in a sandwich pattern above, below or both above and below the motor component in a packing box.

Although the first and second embodiments do not specifically show separate vibration and noise reduction features, the novel techniques used in the later embodiments can be used for either or both the first and second embodiments described above.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan with hook on and fold out blades, comprising in combination:

a ceiling fan motor having a rotating member;

a first mount attached to the rotating member, the first mount being a first blade arm;

a first fan blade having a first interior end portion and a first exterior end portion;

a first hook portion which hooks the first mount to the first interior end portion; and means for eliminating at least one of: vibration and noise between the first mount and the first interior end portion, or lateral and vertical movement between the first mount and the first interior portion.

2. The ceiling fan of claim 1, wherein the means for eliminating includes:

a resilient member for eliminating the vibration and the noise.

3. The ceiling fan of claim 1, wherein the means for eliminating includes:

a post.

4. The ceiling fan of claim 3, wherein the first mount further includes:

a hinge for attaching an exterior portion of the first mount to the first mount, and the post being attached to the exterior portion of an interior portion of the first mount, the hinge having a bent position and an unbent position.

5. The ceiling fan of claim 4, wherein the unbent position includes:

a lock portion for restricting both lateral and vertical movement of the blade to the motor.

6. The ceiling fan of claim 1, wherein the means for eliminating includes:

a slot in the first interior end portion of the first fan blade; and a raised portion adjacent to the first mount for allowing the slot of the first fan blade to be positioned therein.

7. The ceiling fan of claim 1, wherein the means for eliminating includes:

a clip having an expandable portion.

8. The ceiling fan of claim 1, wherein the first blade is reversible.

9. The ceiling fan of claim 1, further including:

a slot in a side of the rotating member.

10. The ceiling fan of claim 9, wherein the first hook portion includes: a post.

11. The ceiling of claim 9, further comprising: a clip.

12. A method of attaching ceiling fan blades to ceiling fan motors, comprising the steps of:

hooking one end of a fan blade to a mount that is adjacent to a ceiling fan motor; and eliminating at least one of: vibration and noise between the fan blade and the fan motor, or lateral and vertical movement between the fan blade and the fan motor.

13. The method of attaching of claim 12, further comprising the step of:

reversing the blade.

14. The method of attaching of claim 12, wherein the hooking step occurs before the motor is hung from a ceiling.

15. The method of attaching of claim 12, wherein the hooking step occurs after the motor is attached to a ceiling.

16. The method of attaching of claim 12, wherein the eliminating step includes:

expanding and contracting a clip.

17. The method of attaching of claim 12, further comprising the step of:

inserting the one end of the blade into a slot adjacent to the ceiling fan motor.

18. A method of attaching blades to a ceiling fan, comprising the steps of:

bending a portion of a mount attached to a ceiling fan motor to create a space;

inserting an edge portion of a fan blade into the space; and folding the blade and the portion of the mount to be substantially perpendicular to a rotation axis of the motor.

19. The method of attaching blades of claim 18, further including the step of:

reducing vibration and noise between the fan blade and the motor.

20. The method of attaching blades of claim 18, further including the step of:

reducing vertical and lateral movement between the fan blade and the motor.

21. The method of attaching blades of claim 18, wherein the step of bending further includes:

bending the portion of the mount substantially 5 to substantially 90 degrees.

22. The method of attaching blades of claim 18, wherein the step of bending further includes:

bending the portion of the mount substantially 30 to substantially 70 degrees.

23. The method of attaching blades of claim 18, wherein the step of bending further includes:

bending the portion of the mount substantially 45 to substantially 55 degrees.

24. The method of attaching blades of claim 18, further including attaching the steps without fasteners.

25. The method of attaching blades of claim 18, further including the step of:

locking the blade and the portion of the mount to be substantially perpendicular to a rotation axis of the motor.

26. The method of attaching blades of claim 25, wherein the step of locking further includes:

expanding and contracting a clip.

27. A method of attaching blades to a ceiling fan, comprising the steps of:

positioning a ceiling fan blade at an angle not perpendicular to a rotational axis of a ceiling fan motor;

inserting an edge portion of the fan blade into an opening adjacent to the ceiling fan motor; and hooking the edge portion of the fan blade within the opening; and folding the blade to be substantially perpendicular to the rotation axis of the motor.

28. The method attaching of claim 27, wherein the angle is less than substantially ninety degrees.

29. The method of attaching of claim 27, wherein the hooking step further includes:

a post being inserted into a through-hole.

30. The method of attaching of claim 27, further comprising:

clipping a portion adjacent to the one edge of the fan blade.

31. A ceiling fan with hook on and fold out blades, comprising in combination:

a ceiling fan motor having a rotating member;

a first mount attached to the rotating member;

a first fan blade having a first interior end portion and a first exterior end portion;

a first hook portion which hooks the first mount to the first interior end portion; and a post member for eliminating at least one of: vibration and noise between the first mount and the first interior end portion, or lateral and vertical movement between the first mount and the first interior portion.

32. The ceiling fan of claim 31, wherein the first mount further includes:

a hinge for attaching an exterior portion of the first mount to the first mount, and the post being attached to the exterior portion of an interior portion of the first mount, the hinge having a bent position and an unbent position.

33. The ceiling fan of claim 32, wherein the unbent position includes:

a lock portion for restricting both lateral and vertical movement of the blade to the motor.

34. A ceiling fan with hook on and fold out blades, comprising in combination:

a ceiling fan motor having a rotating member;

a first mount attached to the rotating member;

a first fan blade having a first interior end portion and a first exterior end portion;

a first hook portion which hooks the first mount to the first interior end portion; and a clip having an expandable portion for eliminating at least one of: vibration and noise between the first mount and the first interior end portion, or lateral and vertical movement between the first mount and the first interior portion.

35. A ceiling fan with hook on and fold out blades, comprising in combination:

a ceiling fan motor having a rotating member;

a first mount attached to the rotating member;

a reversible first fan blade having a first interior end portion and a first exterior end portion;

a first hook portion which hooks the first mount to the first interior end portion; and means for eliminating at least one of: vibration and noise between the first mount and the first interior end portion, or lateral and vertical movement between the first mount and the first interior portion.

36. A ceiling fan with hook on and fold out blades, comprising in combination:

a ceiling fan motor having a rotating member, the rotating member having a side slot;

a first mount attached to the rotating member;

a first fan blade having a first interior end portion and a first exterior end portion;

a first hook portion which hooks the first mount to the first interior end portion, the first hook portion having a post; and a member for eliminating at least one of: vibration and noise between the first mount and the first interior end portion, or lateral and vertical movement between the first mount and the first interior portion.

37. A method of attaching ceiling fan blades to ceiling fan motors, comprising the steps of:

hooking one end of a reversible fan blade to a mount attached to a ceiling fan motor; and eliminating at least one of: vibration and noise between the fan blade and the fan motor, or lateral and vertical movement between the fan blade and the fan motor.

38. A method of attaching ceiling fan blades to ceiling fan motors, comprising the steps of:

hooking one end of a fan blade to a mount attached to a ceiling fan motor; and eliminating at least one of: vibration and noise between the fan blade and the fan motor, or lateral and vertical movement between the fan blade and the fan motor, wherein the step of eliminating includes expanding and contracting a clip.

* * * * *